US006964075B1

(12) United States Patent
Iannacone, Jr.

(10) Patent No.: US 6,964,075 B1
(45) Date of Patent: Nov. 15, 2005

(54) CARPET TRIMMER AND TUCKER

(75) Inventor: Charles P. Iannacone, Jr., Gilbert, AZ (US)

(73) Assignee: Quick Tuck, LLC, Mesa, AZ (US)

( * ) Notice: Subject to any disclaimer, the term of this patent is extended or adjusted under 35 U.S.C. 154(b) by 0 days.

(21) Appl. No.: 10/612,256

(22) Filed: Jul. 1, 2003

Related U.S. Application Data

(63) Continuation-in-part of application No. 10/359,315, filed on Feb. 5, 2003.

(51) Int. Cl.[7] ..... A47G 27/04
(52) U.S. Cl. ..... 7/103; 30/294
(58) Field of Search ..... 7/103, 158; 30/125, 30/278, 294

(56) References Cited

U.S. PATENT DOCUMENTS

| | | | |
|---|---|---|---|
| 2,635,332 | A | 4/1953 | Huntington |
| 2,770,032 | A | 1/1956 | Kelly |
| 2,761,199 | A | 9/1956 | Allen |
| 3,127,299 | A | 3/1964 | Hecht |
| 3,363,314 | A | 1/1968 | O'Brien |
| 3,395,453 | A | 8/1968 | Prater |
| 3,538,523 | A | 11/1970 | Sparks |
| 3,546,726 | A | 12/1970 | Bizzigotti |
| 3,621,573 | A | 11/1971 | Summers |
| 3,737,932 | A | 6/1973 | Armijo |
| 3,934,341 | A | 1/1976 | Carlson |
| 4,095,341 | A | 6/1978 | Crain |
| 4,314,395 | A | 2/1982 | Brock |
| 4,605,253 | A | 8/1986 | Anderson |
| 4,669,190 | A | 6/1987 | Innami et al. |
| 4,750,226 | A | 6/1988 | Costill |
| 4,790,059 | A | 12/1988 | Killpack |
| 4,949,604 | A | 8/1990 | Squires |
| 5,203,852 | A | 4/1993 | Downing et al. |
| 5,984,392 | A | 11/1999 | Iannacone, Jr. |

FOREIGN PATENT DOCUMENTS

| | | |
|---|---|---|
| NL | 7513571 | 5/1976 |

*Primary Examiner*—James G. Smith
(74) *Attorney, Agent, or Firm*—Booth Udall, PLC

(57) ABSTRACT

A bi-directional carpet trimmer and tucker tool has recesses receiving blades in a generally horizontal or slightly angled orientation. The blades and recesses have structure to inhibit rotational and translational movement of the blades in the tool. The tool also has a trailings guide engaging trailings trimmed from an edge of carpet to be tucked. The trailings guide moves the trailings away from at least one tucking wheel along a path generally between a handle and the at least one tucking wheel. This guiding operation inhibits interference of the trailings with tucking and trimming operations.

22 Claims, 14 Drawing Sheets

224
202
306
305
304
303
200
301

202
225
200
227
224
202
204
200
227

224
202
227
200
300
301

303
227
200
202
224
225
128
127
126
129
124
120

CARPET TRIMMER AND TUCKER

This application is a continuation-in-part of U.S. application Ser. No. 10/359,315 filed on Feb. 5, 2003 and entitled "Carpet Trimmer and Tucker".

BACKGROUND OF THE INVENTION

1. Technical Field

This invention relates generally to hand tools used in laying carpet. It relates more specifically to a hand tool which both trims and tucks carpet edges.

2. Background

A carpet tucker is a tool that tucks the edge of a carpet adjacent to a wall or baseboard in order to give the carpet a finished appearance. Tucking presses the edge of the carpet firmly into a tucking trough formed between a tacking strip and a wall or baseboard. U.S. Pat. No. 5,984,392 to Iannacone (the "'392 patent"), the disclosure of which is hereby incorporated herein by reference, discloses a multi-wheeled carpet tucker which works bidirectionally. FIG. 7 of the '392 patent shows the carpet in position to be tucked. FIG. 8 of the '392 patent shows the carpet tucker in operation.

Carpet trimmers of various sorts are known in the art. Carpet trimmers conventionally have vertically-oriented cutting edges and are used to cut the carpet separately from tucking the carpet. Furthermore, the mechanisms for securing the blades in the carpet trimmers of the past require tools and are tedious to manipulate in order to install or replace a blade. Still further, the carpet trimmers of the past are not well adapted to tucking carpet.

SUMMARY OF THE INVENTION

Carpet tools of the past are deficient in providing a combination tucker and trimmer. Furthermore, the tools of the past are deficient in providing trimmers with horizontally oriented cutting edges. Still further, past devices have not adequately addressed trimming carpet at an adjustable height to account for a particular carpet thickness and a particular depth of the tucking trough. Additionally, the past devices have not adequately solved the problem of guiding trailings of the carpet away from a tucking structure to assure more consistent tucking function during use of a combination tucking and trimming tool.

Furthermore, carpet layers often angle their tools to orient the blade perpendicular to the carpet backing. This is because carpet oriented at increasingly larger or decreasingly smaller angles than ninety degrees relative to the blade requires the blade to slice through increasingly more material. Therefore, providing the angle of the blade at an angle generally perpendicular to the carpet backing has the advantage of reducing the material through which the blade must cut and thus reducing the force required to cut through the carpet.

Thus, carpet layers of the past often angled their tools as they made cuts in order to enable better function of the blades and tools overall. This is a less than ideal technique that depends heavily upon the carpet layer's skill and strength. As can be appreciated, maintaining a base plate at the ideal angle other than flat can eventually cause fatigue of certain muscles. In accordance with the present invention, the blades can be held at an ideal angle by structure that supports the blades. This obviates the need to implement this less than ideal practice of manually holding the tool at a specific angle other than flat against the carpet. Now the tool can be held flat on the carpet during trimming and tucking. This alleviates muscle fatigue and enables greater consistency in cutting and speed.

Carpet tuckers and trimmers of the past have also not adequately provided for quick change blades. The past devices are deficient in providing easily releasable blades that are held firmly in by a structure of the tucking and trimming tool in a securing position, yet are released for removal and replacement when the structure has been moved into a non-securing position. Furthermore, the devices of the past are deficient in providing the structure having shapes that are complimentary and/or that provide redundancy in securing the blades. Still further, the devices of the past are deficient in providing blades that have complimentary structure that enables them to be securely held in the trimming and tucking tool. The mating structures of the blades and the devices of the past are deficient in inhibiting translational and rotational movement between the blades and the tools in which the blades are held.

Accordingly, embodiments of the present invention relate to a bi-directional carpet tucker with attached trimmers. The trimmers may be adjusted or sized to cut the carpet to the correct length for tucking. At least two trimmers are provided, one for each of the two directions of operation. A trimmer has a base structure which provides the trimmer blade a height offset from the baseplate of the carpet tucker. The height offset of the trimmers above the baseplate is one factor that determines the extent of tuckable carpet edge that the trimmers will produce. The height offset of the trimmers above the baseplate may be fixed or may be advantageously adjustable to allow for variances in carpet thickness and different depths of the tucking trough. Guides extend from the trimmers to slidingly engage the wall or baseboard to orient the trimmers to cut the carpet edge parallel to the wall or baseboard. The trimmer blades of the trimmers are oriented horizontally. This has the advantage of providing a measurement from the constant benchmark of the floor. Thus, the line of cut can be consistently properly located. Embodiments of the present invention also relate to a retrofit trimmer kit, or retrofit kit, for existing carpet tuckers. The retrofit kit comprises a replacement handle with integral trimmers extending to align with the wheels of existing carpet trimmers.

In a simple form, the present invention is a carpet tucker and trimmer including a base and a handle connected to the base. The carpet tucker and trimmer has at least one wheel connected to the base or to the handle. At least one blade is supported on the base for trimming carpet. A trailings guide is supported on the base or on the handle. The trailings guide extends along a line generally between the at least one wheel and the at least one blade. In particular, the trailings guide is angled to guide trailings away from the at least one wheel. The trailings guide in this case provides the advantage of inhibiting interference by the trailings with the at least one wheel. Furthermore, the configuration that guides the trailings away from the at least one wheel has the advantage of bending the trailings in a direction out of the plane of a backing of the carpet trailing. Thus, resistance is reduced since the trailings are bent in the most natural bending direction for the trailings.

In another aspect, the invention is a combination carpet tool and a blade. The carpet tool in this aspect includes a recess that receives the blade. There is structure in the recess that engages structure on the blade and advantageously holds the blade against rotation. A pin is supported on the tool and traverses the recess when the pin is in an securing position. The blade comprises at least one through opening that is re-entrant or closed. Thus, the pin engages the through opening in the blade and inhibits translational movement of the blade out of the recess when the pin is in the securing position. This provides the advantage of a very secure holding mechanism for the blade. On the other hand, at least a portion of the pin is moved out of the recess and into a non-securing position permitting translational movement of the blade out of the recess.

The pin may be a spring biased pin that can be at least partially removed against the bias of a spring into an extended non-securing position. Thus, the spring biased aspect of the invention provides the advantage of a quick and easy release of the blade from the recess and from the tool. Alternatively, the pin may take any of a variety of easily removable pins including a pin having threads, a pin having a notch receiving a spring clip that-is attached to the rest of the tool, or a pin having a spring biased detente. In each of these cases a retaining structure comprises structure on the pin and structure on the rest of the tool for holding the pin on the rest of the tool in a securing position.

The structure in the recess can include one or more protrusions having a shape that is complimentary to one or more through openings in the blade so that the structure in the recess and the complimentary structure of the through openings inhibit rotational movement of the blade relative to the carpet tool. Additionally, the pin can have a cross section of a particular shape that is complimentary to the through opening that is adapted to receive the pin in the blade. In this way, the pin and complimentary structure on the blade can inhibit both translational and rotational movement between the blade and the carpet tool. The particular structure of the complimentary shapes may provide advantages of additionally inhibiting rotational or translational movement of the blade relative to the tool.

In still another aspect, the invention includes a blade for a tool, such as a carpet tool. In a simple form, the blade has a plurality of sides forming a tetrahedral shape. The blade further has two securing regions spaced along at least one of the sides of the blade. The securing regions have cutout portions. The cutout portions include at least one oblong or polygonal through opening defined by a wall extending through the blade. These shapes can provide the advantage of inhibiting rotational movement as set forth above. Typically, the blade is elongated and the securing regions are located generally at opposite longitudinal ends. One longitudinal end can be a mirror image of the other longitudinal end so that the blade is advantageously reversible by turning the blade over end-to-end about a short axis of the blade. In particular, the through openings can have polygonal and/or oblong shapes for interacting with recess or pin structure in a complimentary way to inhibit translational and rotational movement of the blade relative to the tool. The particular polygonal or oblong shapes can provide the additional advantage of identifying the blade with the tool of the present invention. The quality and proper sizing of the blade can be assured by matching the shape of the through opening(s) in blades to be acquired with the corresponding structure in the recess or on the pin of the tool. Thus, use of inferior blades can be inhibited since a blade having a through hole of a particular shape will be required for use with the tool.

The through openings can be formed by cutting material out of the blade during manufacture. Alternatively, the through openings can be punched, molded, drilled, or die cast. The through openings can take any of a variety of forms. For example, the through openings can be a closed through opening. This means that the through openings' shapes form complete circuits within the perimeter of the blade and do not reach an edge of the blade. In another form, the through openings are referred to as notches. These notches are open through openings that open out to at least one edge of the blade. In still another form, the through openings are reentrant through openings or notches. This type of notch has a narrow first width dimension at a portion of the notch located a first distance relatively close to where the notch opens out into an edge formed by one of the sides of the polygonal blade. The reentrant notch further has a second width dimension that is wider at a second distance further away from the edge.

Many of the deficiencies and inadequacies of past carpet tools have been overcome as set forth in the description above. Additional advantages and improvements over devices of the past may become apparent through the following detailed description of the invention and the accompanying drawings.

BRIEF DESCRIPTION OF THE DRAWINGS

The foregoing and other features and advantages of the carpet trimmer and tucker will be apparent from the following more particular description of specific embodiments of the carpet trimmer and tucker, as illustrated in the accompanying drawings, wherein.

DETAILED DESCRIPTION OF EMBODIMENTS OF THE INVENTION

Figure 1A:
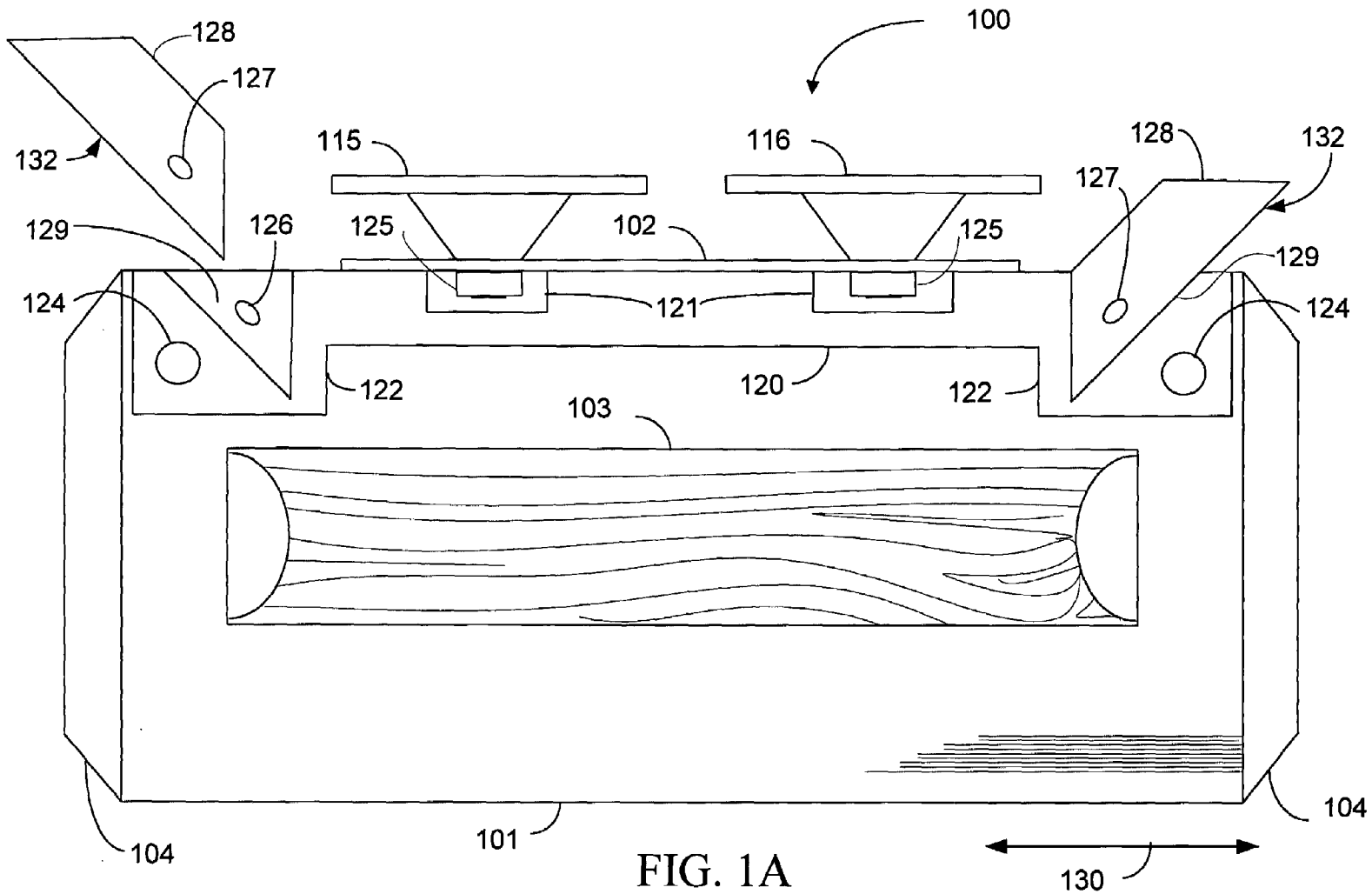
FIG. 1A is a top plan view of an exemplary embodiment of the carpet trimmer and tucker without the trimmer cover plates installed.

Referring now to the figures, FIG. 1A shows a top plan view of an exemplary embodiment of a carpet trimmer and tucker 100 having baseplate 101, handle 103, and a plurality of wheels 115–116 mounted on vertical wheel support flange 102. The baseplate 101 has upturned ends 104 to enable the baseplate 101 to slide easily in either direction 130. Trimmer base structures 122 are shown as shaped metal blocks integral to alignment bar 120. The top surface of trimmer base structures 122 may have a recess or an indentation 129. Indentation 129 may form part of a cavity for receiving and holding trimmer blade 128. Indentation 129 further comprises at least one bore 126 which aligns with at least one bore 127 in trimmer blade 128 to receive a retaining mechanism which will be discussed more fully below.

Referring to FIG. 1A, the trimmer blade 128 on the left side of the drawing is shown outside the indentation 129, whereas trimmer blade 128 on the right side of the drawing is shown in right-hand cavity 129. The long edge of trapezoidal trimmer blade 128 is the sharp edge. In other embodiments, other trimmer blade 128 shapes may be used. Various embodiments may have a differently shaped retaining bore 127, multiple training bores 127, or use one or more indentations in the blade edge as alignment keys. Only about half of the sharp edge of the trimmer blade 128 is used at a time. It may be useful for the blades 128 and bores 127 to be bilaterally symmetrical (see 128 in FIG. 2) so that the blade may be reversed after it gets dull. In an alternate embodiment, each trimmer may use two blades 128, with the sharp edges arranged in a "V" to make the cutting more precise. In a further alternate embodiment, the two blades may be motorized, as is known in the art of electric scissors.

Trimmer base structures further comprise at least one fastener adaptation 124, such as bolt hole 124, for holding the cover plate 200 (FIG. 2) to the trimmer base structures. In some embodiments, bolt holes 124 also align with threaded bolt holes in baseplate 101 to fasten trimmer base structure 122 to baseplate 101.

Alignment bar 120 maintains the trimmer base structures 122 in alignment with each other and in a functional relationship with wheels 115–116. Alignment bar 122 may have indentations 121 to accommodate fasteners 125 (for example, nuts 125), which hold wheels 115–116 to wheel support flange 102. In some embodiments, alignment bar 120 may be attached to the wheel support flange 102. In some other embodiments, alignment bar 120 may be absent. In an alternate embodiment without alignment bar 120, trimmer base structures 122 may be integral to the handle 103 which serves to align the trimmer base structures 122.

In an alternate embodiment, trimmer base structures 122 may comprise mechanisms for adjusting the height of the top surface of each trimmer base structure 122 relative to the top surface of baseplate 101. For example, the trimmer base structure may comprise a scissor jack mechanism with a height adjustment knob which the user can easily manipulate. By adjusting the height of the trimmer base structure 122, the operational height of trimmer blade 128 is adjusted, thus changing the length of the trimmed, tuckable edge 802 (FIGS. 7–8) of the carpet.

Figure 1B:
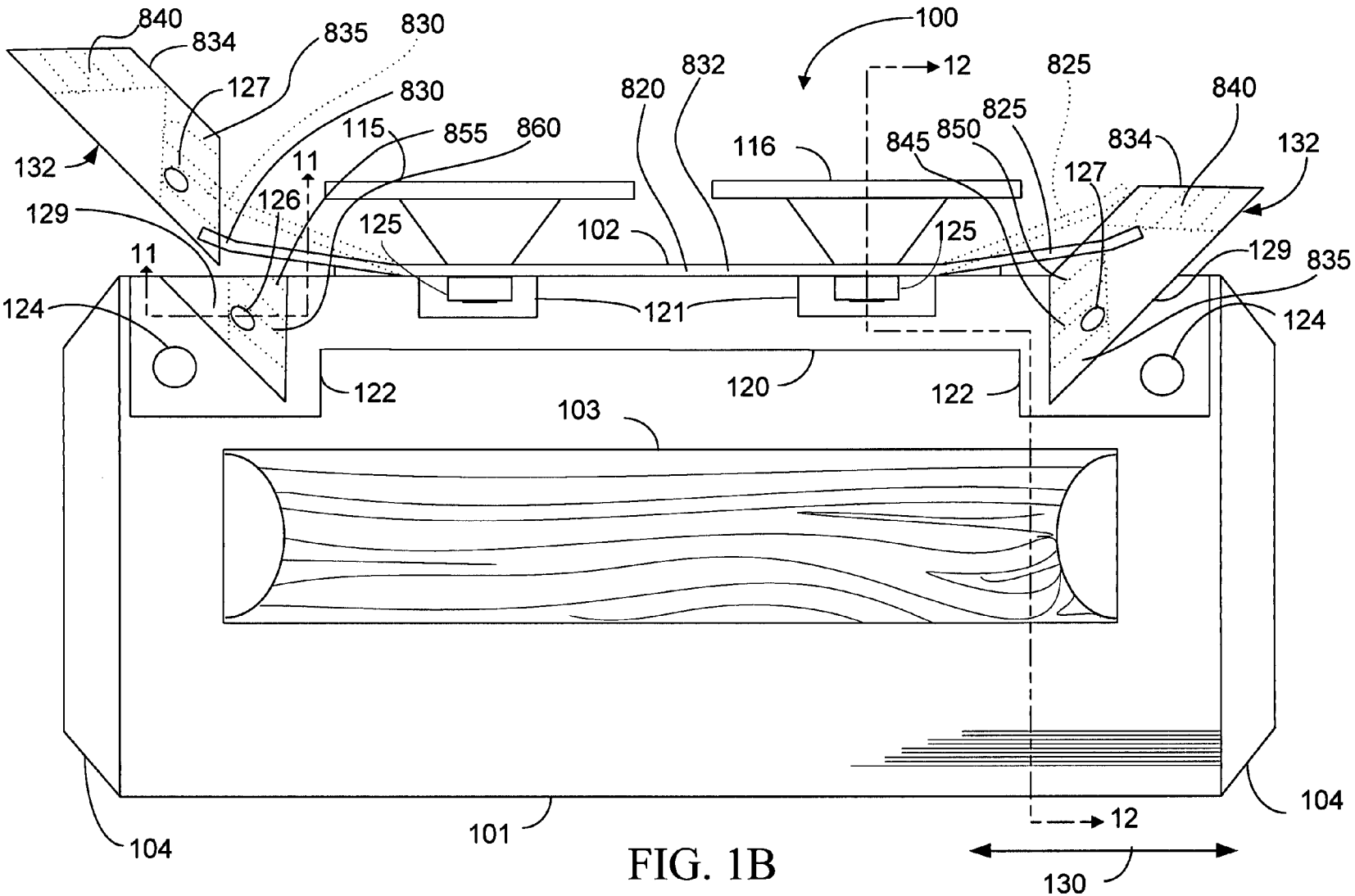
FIG. 1B is a top plan view similar to that of FIG. 1 and showing a modified embodiment of the carpet trimmer and tucker.

FIG. 1B is similar to FIG. 1A. However, FIG. 1B shows particulars of a modified embodiment including a trailings guide 820 with a first end 825 and a second end 830 extending away at a slight angle from a central portion 832. The first and second ends 825, 830 of the trailings guide are alternatively shown in dashed lines depicting an increased angle of bend relative to a central portion 832. Throughout the figures, dashed lines are used to represent alternative features, demarcate regions, show hidden structure as hidden lines, and as leaders to features shown in dashed lines. It is expected that the different use of the dashed lines will be apparent based on the context and by reference to the pertinent portions of the detailed description. For the trailings guide, it is to be understood that the ends 825, 830 may be straight, comprise a plurality of discrete bends, or may be continuously arcuate. In any case, the ends 825, 830 will have an angle and a reach to consistently engage trailings that are caused by the blades 128 or modified blades 834 when the tool 100 is moved along an edge of carpet that is being trimmed.

FIG. 1B also shows first and second securing regions 835, 840 on the modified blades 834. One or more through openings in areas 845, 850 are provided in the first and second securing regions 835, 840 to provide complimentary structure for receiving structure disposed in areas 855, 860 in the recesses or indentations 129. The complimentary structures in areas 845, 850 and the structure in areas 855, 860 of the recesses 129 are configured to inhibit rotational and/or translational movement of the blades 834 when the blades 834 are engaged in the recesses 129 as will be described in greater detail below. It is to be understood that the blades 128 lie within the spirit and scope of modified blades 834. This is made apparent by the fact that the bore 127 in blade 128 lies in area 845 of the modified blade 834.

Figure 2A:
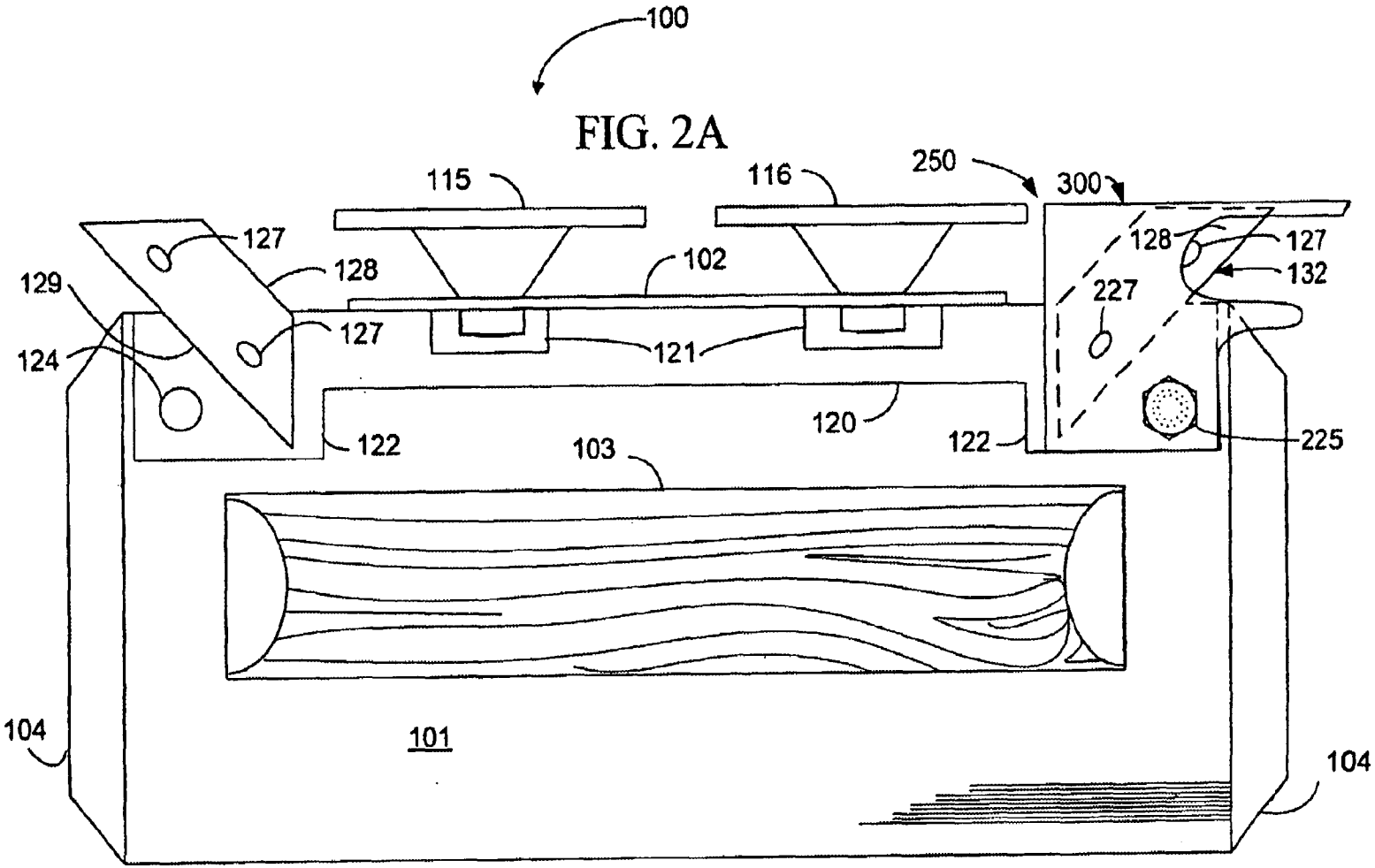
FIG. 2A is a top plan view of an exemplary embodiment of the carpet trimmer and tucker with details of the trimmer cover plates.

FIG. 2A shows a top plan view of an exemplary embodiment of a carpet trimmer and tucker 100 with cover plates 200 and fasteners 225 for safety. Referring to cover plate 200 on the left side of the drawing, cover plate 200 comprises a shaped plate having at least one adaptation 224 for a fastener 225. For example, a bolt hole 224, aligns with bolt hole 124 in the trimmer base structure 122, for receiving bolt 225 to fasten cover plate 200 to base support structure 122. Cover plate 200 may form a trimmer blade cavity for holding a portion of trimmer blade 128 when cover plate 200 covers indentation 129 in the trimmer base structure 122. Channel 202 functions to guide the carpet to the trimmer blade 128. Retaining mechanism adaptation 227 may be a retaining bore 227 which aligns with retaining bore 127 in trimmer blade 128 and bore 126 in trimmer base structure 122 to receive a retaining pin.

On the right side of FIG. 2A, cover plate 200 is shown installed on the trimmer base structure 122 using fastener 225 to form trimmer 250. Trimmer blade 128 is installed in the blade trimmer cavity 129 and 204 with a sharpened edge 132 (FIG. 1) exposed within carpet channel 202. The portion of the trimmer blade 128 inside the trimmer blade cavity 129 and 204 is shown using a dashed line. The shape of channel 202 is exemplary and the invention contemplates a wide variety of shapes that will confine the carpet edge sufficiently to permit trimming. Cover plate 200 may be made of metal, ceramic, composites, including carbon fiber and boron-epoxy composites, or other rigid material.

The cover plate 200 may comprise a guide 300 adapted to slide along a wall 612 or baseboard 614 (FIG. 6) to maintain wheels 115–116 the proper distance from the wall 612 or baseboard 614. In exemplary embodiment 100, the guide is aligned to the wheels 115–116. In some embodiments, the cover plate may maintain the guide 300 farther out than the wheels 115–116. For example, where the baseboard 614 is short, it may be desirable to extend the guide over the baseboard 614 to engage the wall 612. In an alternate embodiment, the extension of the guide 300 from the cover plate 200 may be adjustable. For example, a screw adjustment may be provided for adjusting the extension of the guide 300 from the cover plate 200. In other embodiments, the guide 300 may comprise a horizontally disposed wheel adapted to role along the wall 612 or baseboard 614.

Cover plate 200 may be fastened to trimmer base structure 122 with one or more fasteners 225. In embodiments without an alignment bar 120, a plurality of fasteners 225 may be preferred to prevent rotation of the cover plate 200 about the fastener 225, particularly where the fasteners 225 also connect the trimmer base structure 122 to the baseplate 101. In an alternate embodiment, the cover plate 200 may be permanently affixed to the trimmer base structure 122. In another alternate embodiment, cover plate 200 and trimmer base structure 122 may be integral and comprise a machined-out trimmer blade cavity.

Figures 2B, 3A, 3B, 3C:
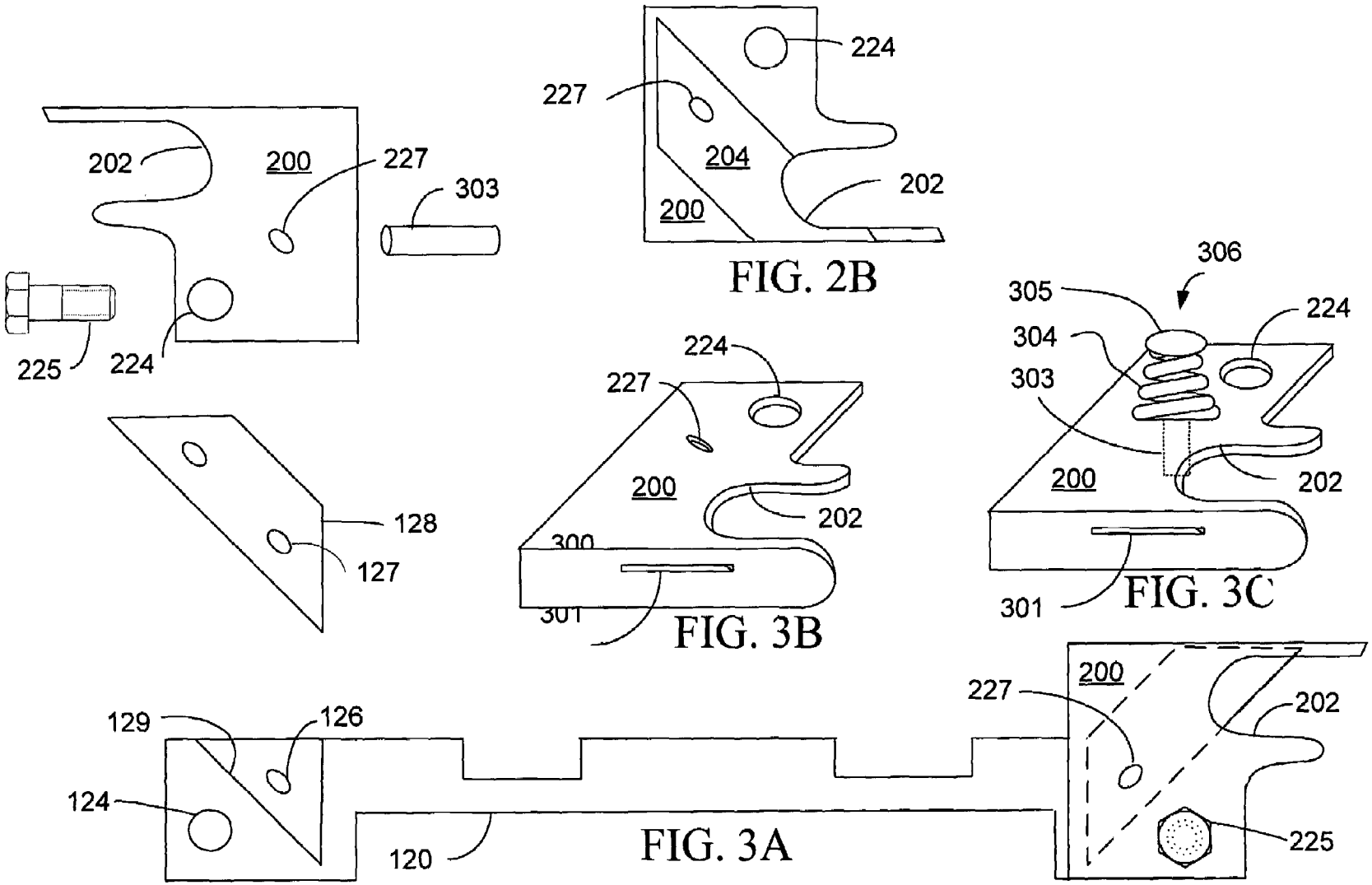
FIG. 2B is a bottom plan view of an exemplary embodiment of the cover plate.
FIG. 3A is a top plan view of an exemplary embodiment of the carpet trimmers.
FIGS. 3B–3C are perspective views of exemplary cover plates with integral guides.

FIG. 2B shows the under side of an exemplary cover plate 200 comprising indentation 204 for forming the trimmer blade cavity. Alternatively, the trimmer blade cavity may be entirely in the top of the trimmer base structure 122, as with trimmer blade cavity indentation 129. In some embodiments, the trimmer blade cavity may be formed by aligned indentations 204 and 129 in the cover plate 200 and in the trimmer base structure 122, respectively.

FIG. 3A shows the exemplary alignment bar 120 and integral trimmer base structures 122 apart from the baseplate 101. FIG. 3A shows the alignment of retaining mechanism adaptations, such as retaining pin bores 227, 127, and 126 to receive retaining pin 303 (see FIG. 3C). A variety of retaining mechanisms are contemplated by the invention. The bores 227, 127, and 126 may be of any cross-sectional shape. The use of retaining pins, locks, clamps, and the like are within the scope of the invention.

Figure 6:
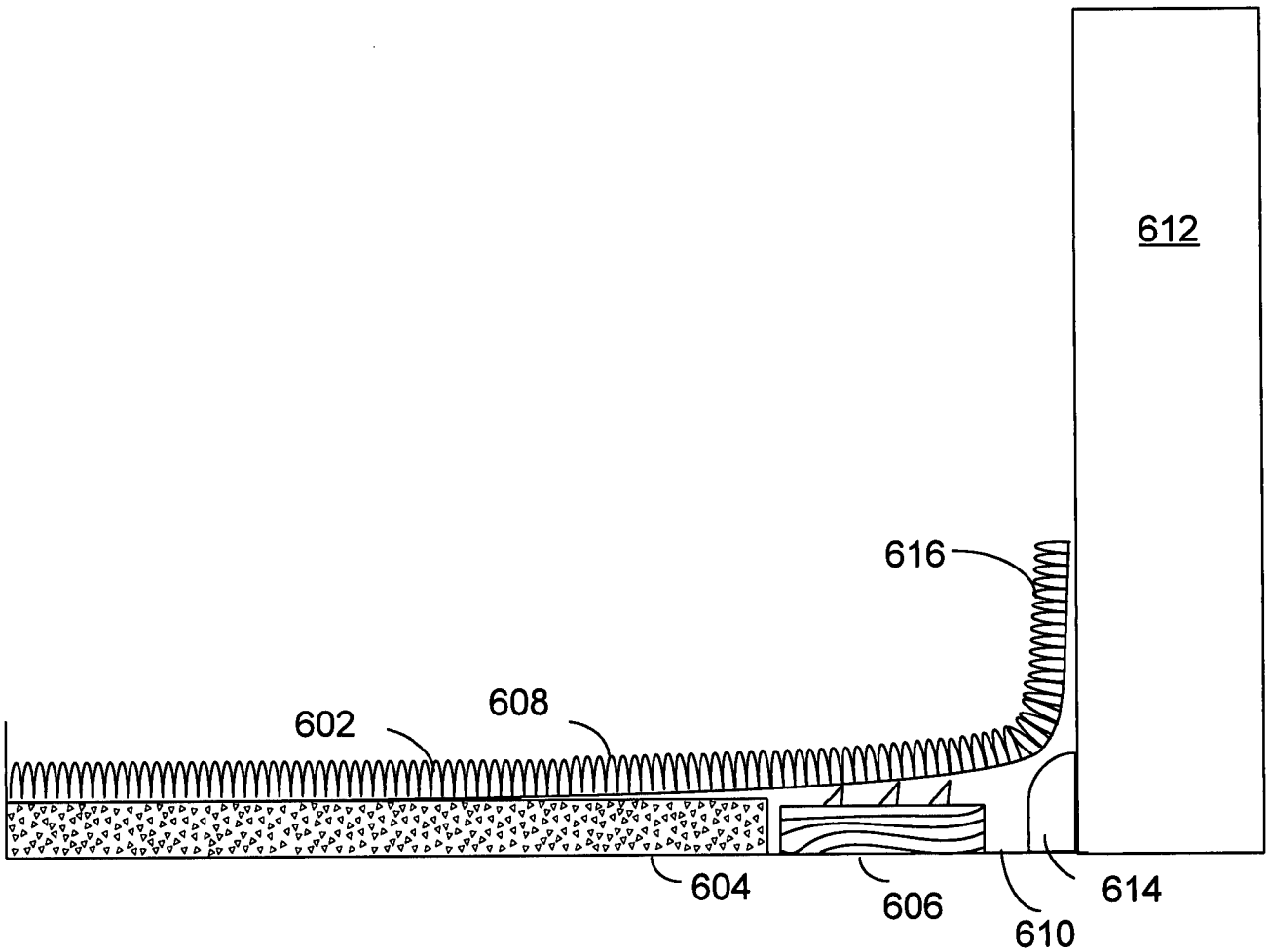
FIG. 6 is a side elevation view of carpet that needs to be trimmed and tucked.

FIG. 3B shows the exemplary cover plate 200 and integral guide 300 in a perspective view. Slot 301 in guide 300 provides access to the blade trimmer cavity for removing an old trimmer blade 128 and inserting a new trimmer blade 128. Slot 301 makes it unnecessary to loosen fastener 225 (FIG. 3A) in order to change trimmer blade 128. The slot 301 may alternatively be located on one of the other sides of the trimmer 250 (FIG. 2A) and adapted in shape and size accordingly. The end of guide 300 which initially engages the carpet may be rounded, as shown, and tapered. Tapering makes it easier to catch carpet that is resting against the wall 612 or baseboard 614 (FIG. 6).

FIG. 3C shows an exemplary retaining mechanism 306 comprising a biasing mechanism 304, or spring 304, retaining pin 303, and knob 305. Spring 304 tension biases retaining pin 303 into the inserted position. The user may pull upward on the knob 305 against the tension of spring 304 to extract pin 303 from the aligned retaining bores 227, 127, and 126, thereby releasing the trimmer blade 128.

Figures 4A, 4B, 4C:
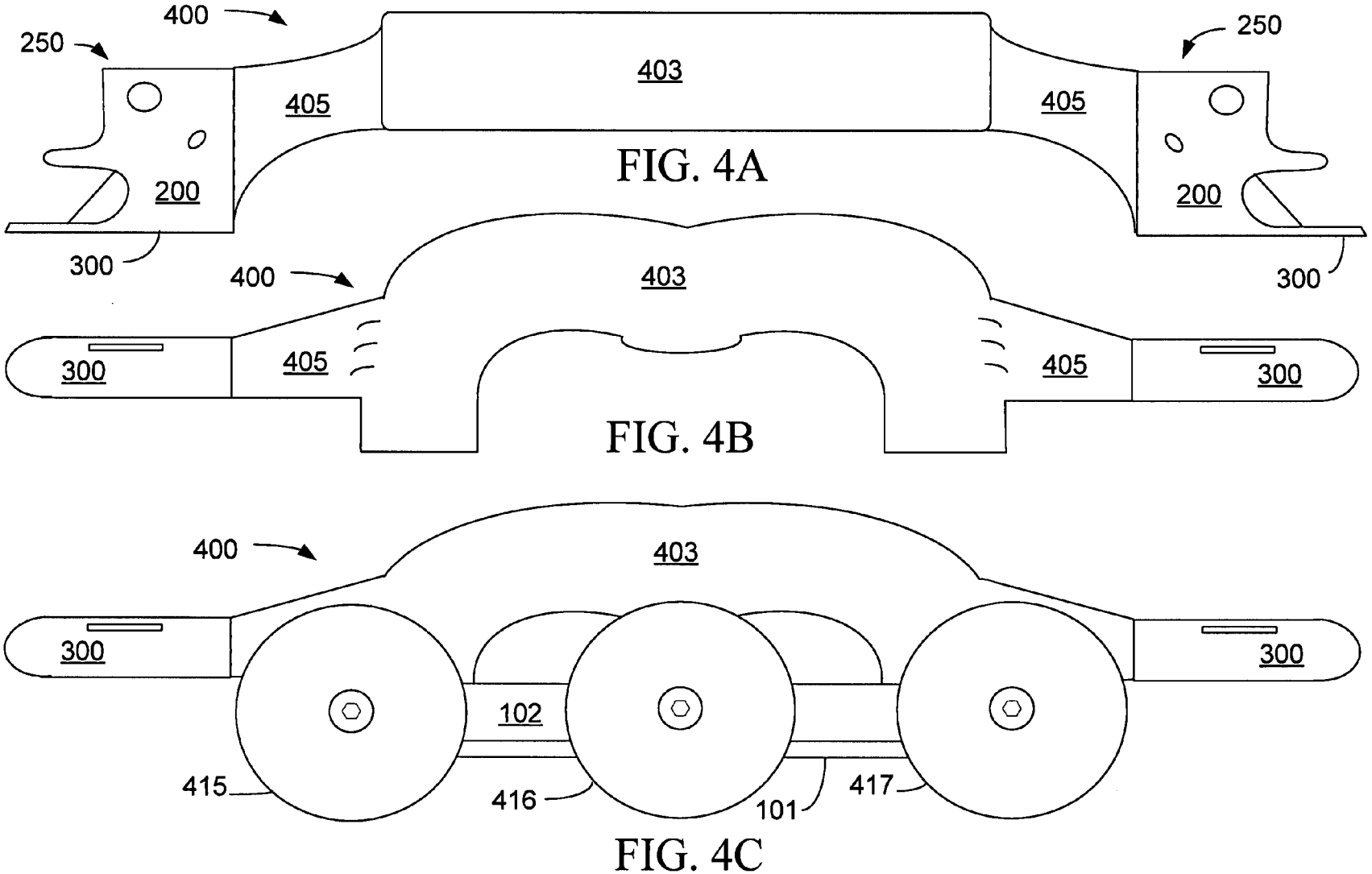
FIG. 4A is top plan view elevation view of an exemplary embodiment of the retrofit trimmers.
FIG. 4B is a side elevation view of an exemplary embodiment of the retrofit trimmers.
FIG. 4C is a side elevation view of an exemplary embodiment of the retrofit trimmers on an existing baseplate of a 3-wheeled carpet tucker.

FIG. 4A shows a top plan view of exemplary retrofit kit 400 for use with trimmers 250 (FIG. 2) and is adapted to existing 3-wheeled carpet tuckers. The trimmers 250 (FIG. 2) are integral with extensions 405 which are integral to grip 403. The retrofit kit may further comprise new fasteners for attaching the retrofit kit 400 in place of the handle of the original carpet tucker. Extensions 405 may be made of any rigid material. Trimmers 250 may alternatively be any of the adjustable embodiments discussed above. In alternate embodiments, the retro fit kit 400 may comprise integral extensions 405 and trimmers 250, wherein the extensions attach to the original handle. In yet another alternate embodiment, retrofit kit comprises discrete trimmers 250, extensions 405, and grip 403, which may be connected to a carpet tucker to form a carpet trimmer and tucker. In some alternate embodiments, extensions 405 may be adjustable in size and/or orientation.

FIG. 4B shows a side elevation view of the exemplary retrofit kit 400. Extensions 405 are shown elevated above the lowest ends of grip 403, which lowest ends attach to the existing baseplate 101 (FIG. 4C). In alternate embodiments, extensions 405 may contact, conform to, and/or connect with baseplate 101 of the existing carpet tucker. FIG. 4C shows a side elevation view of the exemplary retrofit kit 400 installed on conventional baseplate 101 having wheel support flange 102 and wheels 415–417. In some embodiments, a carpet deflector 502 (see FIGS. 5 and 9) may be an integral or attachable part of a retrofit kit 400. The carpet deflector 502 serves as a cowling or shield to prevent carpet trimmings 816 (FIGS. 7 and 8) from becoming entangled in the wheels 415–417.

Figure 5A:
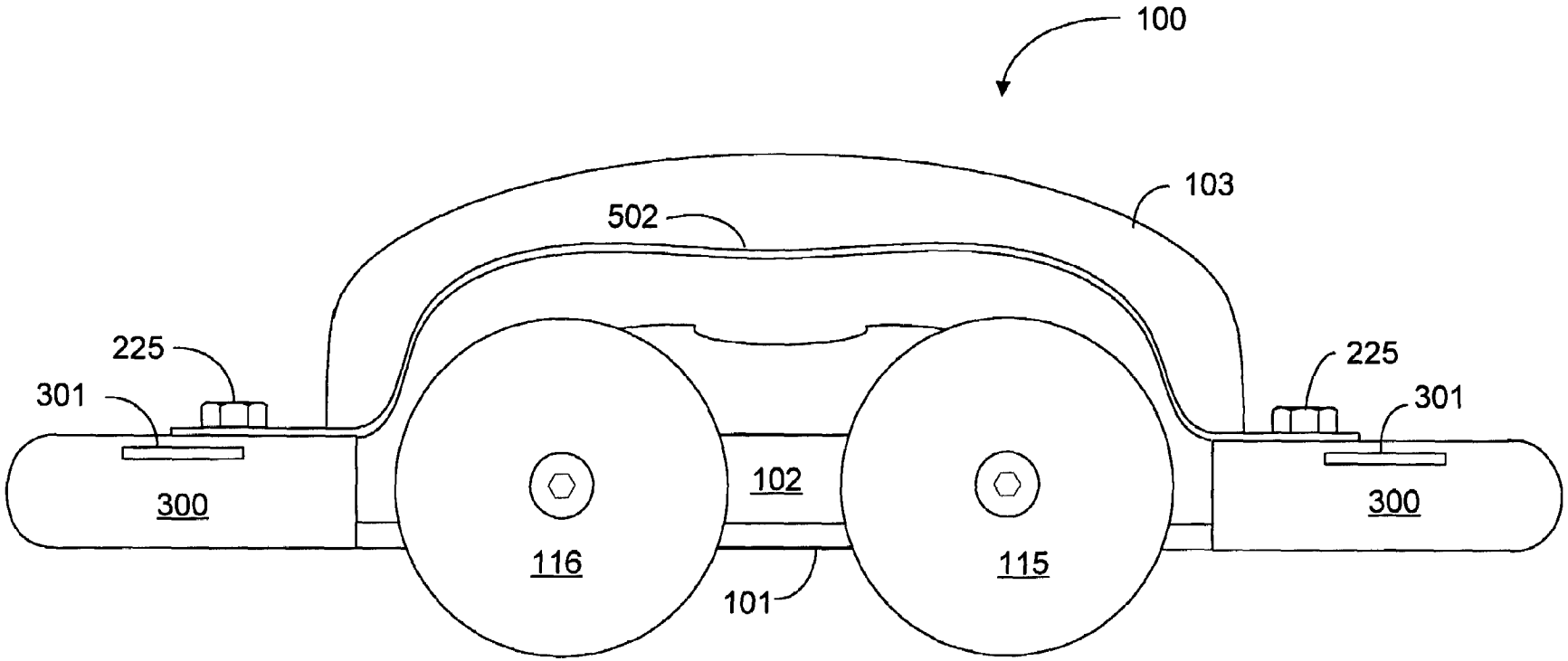
FIG. 5A is a side elevation view of an exemplary embodiment of the carpet trimmer and tucker with a carpet deflector.
Figure 9A:
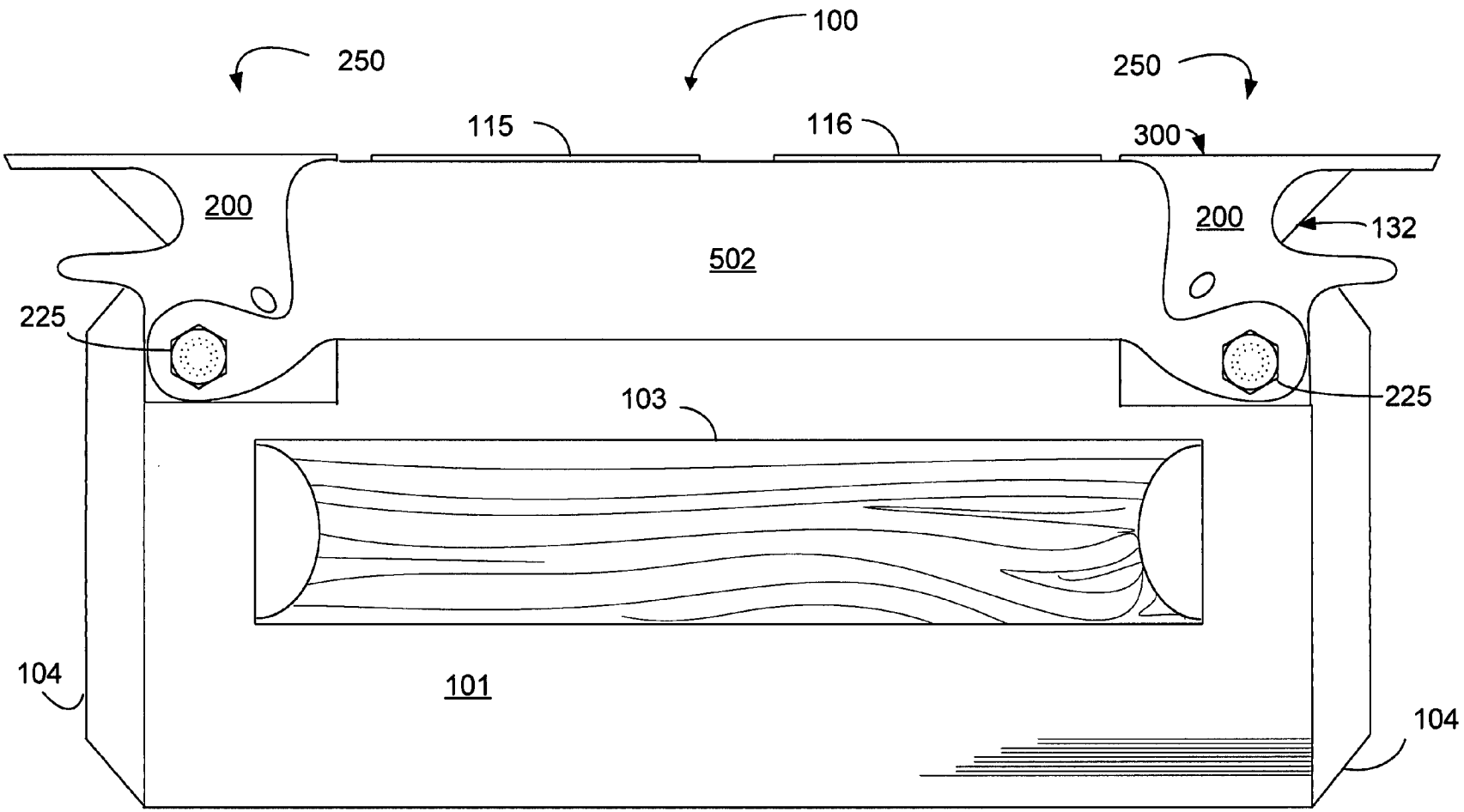
FIG. 9A is a top plan view of an exemplary embodiment of the carpet trimmer and tucker with a carpet deflector.

FIG. 5A shows a side elevation view of the exemplary embodiment 100. Carpet deflector 502 is shown attached to trimmers 250 by fasteners 225. The carpet deflector 502 deflects carpet trimmings created by the trimmers 250 in order to keep carpet trimmings from becoming entangled in the wheels. FIG. 9A shows a top plan view of the exemplary embodiment 100 with a carpet deflector 502 installed. Alternatively, the carpet deflector 502 may attach to handle 103, to baseplate 101, or to wheel support flange 102.

Figure 5B:
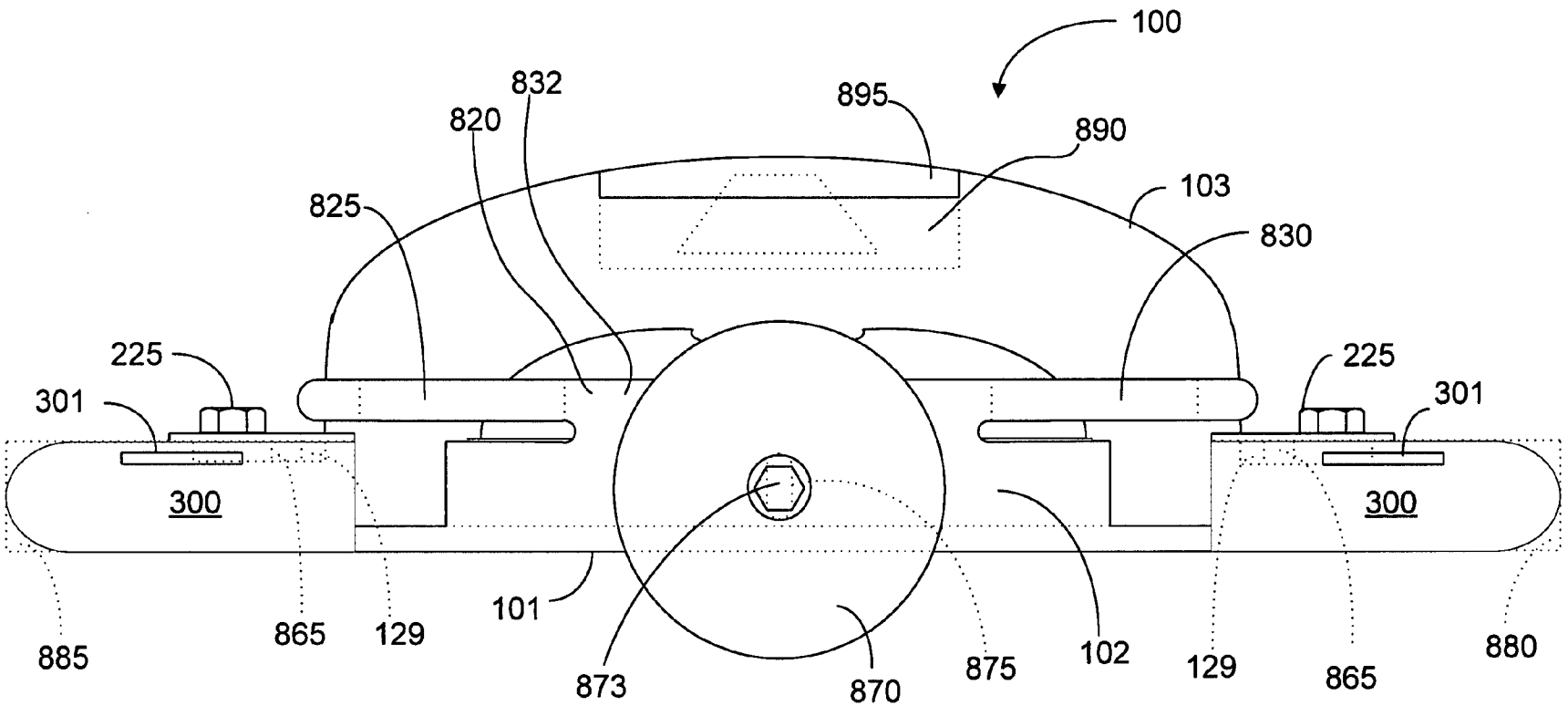
FIG. 5B is a side elevation view similar to that of FIG. 5A and showing the modified embodiment of the carpet trimmer and tucker.

FIG. 5B shows a carpet deflector corresponding to the modified embodiment of FIG. 1B. That is, the carpet deflector is the trailings guide 820 with the first and second ends 825, 830 and the central portion 832 formed substantially integrally with the wheel supporting flange 102. Indentations or recesses 129 are shown without blades. At least one protrusion 865 is provided in the recess in an area corresponding to at least one of the areas 855, 860 shown in FIG. 1B. In one particular embodiment, a protrusion 865 shown in hidden lines is provided in one of the areas 855, 860 while a spring biased pin or bolt 303, (such as shown with retaining mechanism 306 in FIG. 3C), is provided in the other of areas 855, 860. This protrusion 865 and the spring biased pin or bolt 303 can selectively interface with through openings in each of the first and second securing regions 835, 840 of the blades 128. A through opening in one of the areas 845, 850 can have a closed periphery like bores 127 described above. A through opening in the other of areas 845, 850 can be an oblong notch with an open periphery that opens out into one of the edges of the blade 128 generally in the form of the dashed line showing area 850 in FIG. 1B. Thus, the protrusion 865 can be a rigid protrusion that slidable engages the oblong notch when the blade 128 is inserted or removed from the tool. For example, to replace a blade 128, the spring biased pin or bolt 128 is retracted from the closed through opening or bore 127 in the blade 128. Then the blade is slid relative to a protrusion 865 shown in FIG. 5B. This protrusion 865 can correspond in shape and size to the area 855 shown in FIG. 1B, or can be smaller. Thus, the blade can be slid out and another like blade slid into its place while the pin or bolt 303 is retracted. Then the pin or bolt 303 is released for biased movement into its non-retracted position locking the replacement blade into position. In this way, the blades 128 can be quickly and easily installed and removed, yet be substantially restrained from rotational and translational movement as will be further described below.

It is to be understood that the trailings guide 820 may be added on as opposed to being formed integrally with the rest of the tool without departing from the scope of the invention. Furthermore, while the protrusions 865 have been described as part of the structure of recesses 129, these protrusions 865 could alternatively be formed as studs or the like on undersides of cover plates 200 (see FIG. 4A) without loss of function. In fact, some advantages in ease of manufacture and material strength are accomplished by providing protrusions on the underside of the cover plates 200.

If the shape of the protrusion 865 is made to be a compliment of a shape of the oblong notch into which it fits, the protrusion will better inhibit rotation of the blade relative to the tool. To this end, the protrusion can have a first dimension. The structure on the blade comprises an oblong notch having a width of a second dimension. The first dimension is complimentary to the second dimension so that the protrusion is received into and removed from the notch in a relative translational motion, yet cannot be rotated due to interference between the protrusion and inner walls defining the oblong notch. It is to be understood that the protrusion typically will be oblong in the same direction as the oblong notch. In fact, with increased dimension in a direction along a longitudinal aspect of the notch the resistance to rotation is increased. However, any minimal dimension of the protrusion along the longitudinal direction will function to some degree.

FIG. 5B also shows a modification of the carpet trimming and tucking tool 100 in which only one wheel 870 is supported on the wheel supporting flange 102. A bolt 873 can be used to support the wheel 870, which is substantially similar to wheels 115 and 116. In particular, a slot 875 is provided in the wheel supporting flange 102 for adjustably receiving an axle of the wheel 870 so that the height of the base 101 can be adjusted. Another modification can be applied to the carpet trimming and tucking tool 100 as shown by squared ends 880, 885 of guides 300. These squared ends have the advantage of aiding in tucking carpet in a tucking trough near corners of a room where the wheels 115, 116, and 875 will not reach. A still further modification shown in FIG. 5B comprises a recess 890 in the handle 103 for receiving blades 128, 834. The recess may be formed by a molded wall or the like and can be closed by a cover 895 such as a flip top cover. The recess 890 and cover 895 have the advantage of enabling storage and easy access to blades 128, 834 for quick replacement without the need to leave the tool 100 or walk elsewhere to get more blades. The cover may advantageously form a generally smooth uninterrupted surface with the rest of the handle for an aesthetic appearance and a comfortable grasping area.

Figure 9B:
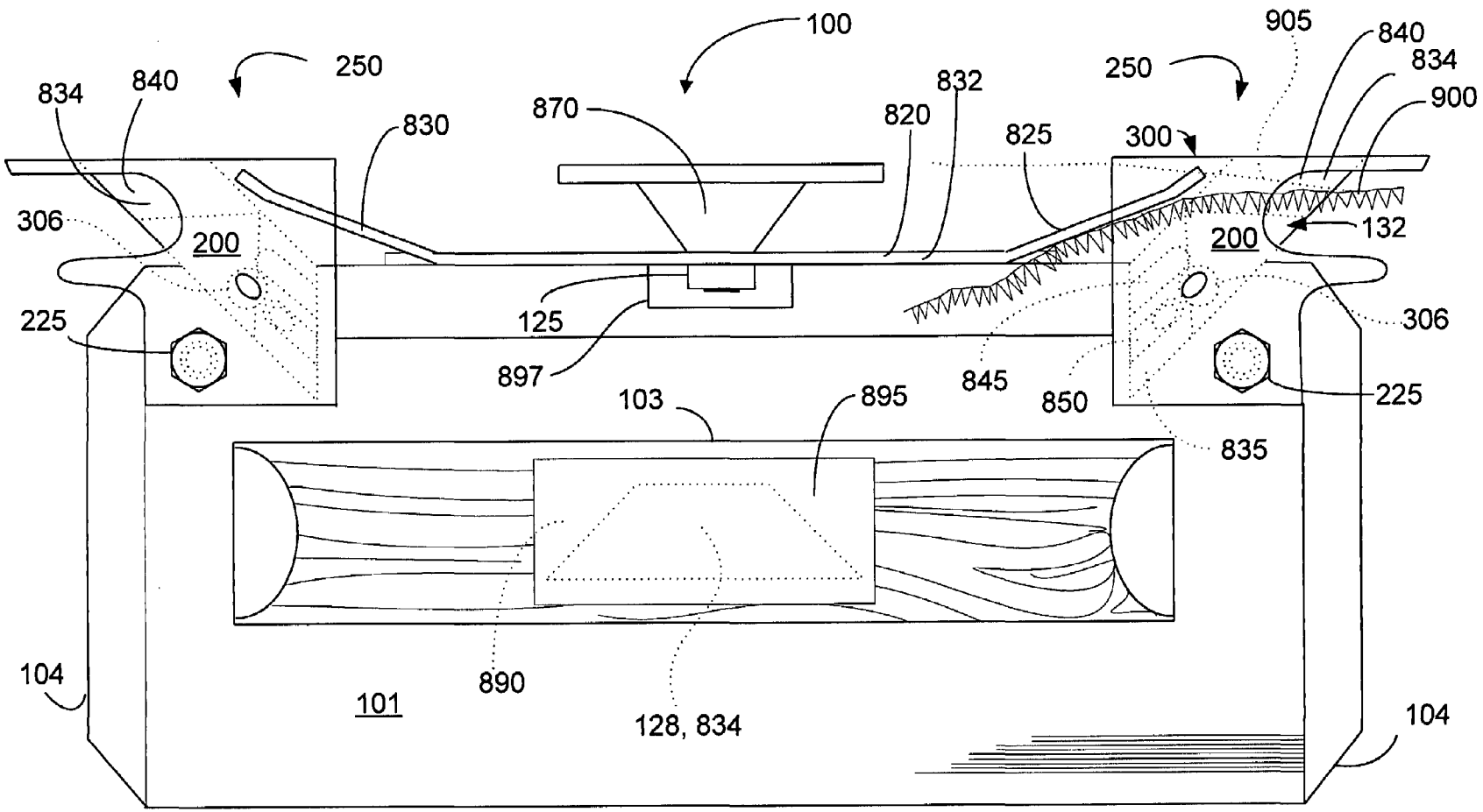
FIG. 9B is a top plan view similar to that of FIG. 9A and showing the modified embodiment of the carpet trimmer and tucker.

FIG. 9B shows a trimming and tucking tool corresponding to the modified embodiments of FIGS. 1B and 5B. In particular, FIG. 9B is a top plan view similar to FIG. 1B showing the trimmings guide 820, only one tucking wheel 870, the recess 890, and the cover 895 on the handle 103. FIG. 9B also shows the cover plates 200 installed. With the cover plates 200 installed, relationships of modified blade and recess structure becomes more apparent. For example, the location of the spring biased retaining mechanism 306 described with reference to FIG. 3C above is shown by dashed lines on each of the cover plates 200. It is noted that these retaining mechanisms 306 do not overlie securing regions 835, 840 of the blades 834 in FIG. 9B. However, the retaining mechanisms 306 can be provided additionally or alternatively in overlying relation to the regions 835, 840 of the blades 834, and in particular in overlying relation to through holes in areas 845, 850 of the blades. In this way, pins 303 (see FIGS. 3A–3C) of retaining mechanisms can engage in through openings in areas 845, 850 of the modified blades 834.

Also shown in FIG. 9B is an indentation 897 similar to the indentation 121 described above and a nut 125 for holding the single wheel 870 on the flange 102. As can be appreciated, the trailings guide 820 engages and guides the carpet trailing 900 away from the wheel 870. As shown, the trailings guide is between the wheel 870 and the handle. Thus, the trailings 900 are guided on one side of the trailings guide 820 between the trailing guide 820 and the handle 103. The line on which the trailings 900 are guided is generally transverse to a line through the centroids of the wheel and the blade 128, 834. However, the cut edge 900 of the carpet to be tucked moves along a line toward a plane of the wheel 870 and the tucking trough into which the cut edge 905 is tucked. In this way, the carpet trimmer and tucker 100 advantageously trims and guides the cut edge 905 into a tucked position and simultaneously guides the trailings 900 away from interference with the wheel 870.

The configuration of the trailings guide 820 can additionally be described relative to the blades 128, 834 and the at least one wheel 870 as shown in FIG. 9B. The blades 128, 834 have an exposed cutting edge as indicated at 132 on the right hand side of the tool 100 in FIG. 9B. The first end 825 extends away from the central portion 832 to a position generally between the at least one wheel 870 and the cutting edge. Likewise, the second end 830 extends away form the central portion in a direction generally opposite to the first end so that the second end extends generally between the at least one wheel and a cutting edge of a second blade. This relationship is possible because the flange 102 is positioned between the at least one wheel 870 and the handle 103. Another aspect of the trailings guide is that the first and second ends 825, 830 extend away from the handle 103 toward a plane of the at least one wheel 870. This structure enables the trailings guide 820 to guide carpet trailings away from the at least one wheel 870 as the trailings move generally toward the central portion 832 of the trailings guide 820 from either direction.

FIG. 6 shows a side elevation view of carpet in need of tucking and trimming. Carpet 602 rests on carpet pad 604 until a carpet portion 616 resting against the wall 612 or baseboard 614, or a carpet portion supported on the points of tacking strip 606, lifts the carpet portion 608 above the carpet pad 604. Trimming will remove excess carpet portion 616, leaving an appropriately sized carpet edge to be tucked into gap 610 between tacking strip 606 and baseboard 614 by the wheels 115–116 (FIG. 5) of the carpet trimmer and tucker 100 (FIG. 5). Conventionally, the carpet 602 is trimmed by a hand blade and then separately tucked with a carpet tucker. The conventional method is time consuming and less accurate than the present invention.

Figures 7, 8:
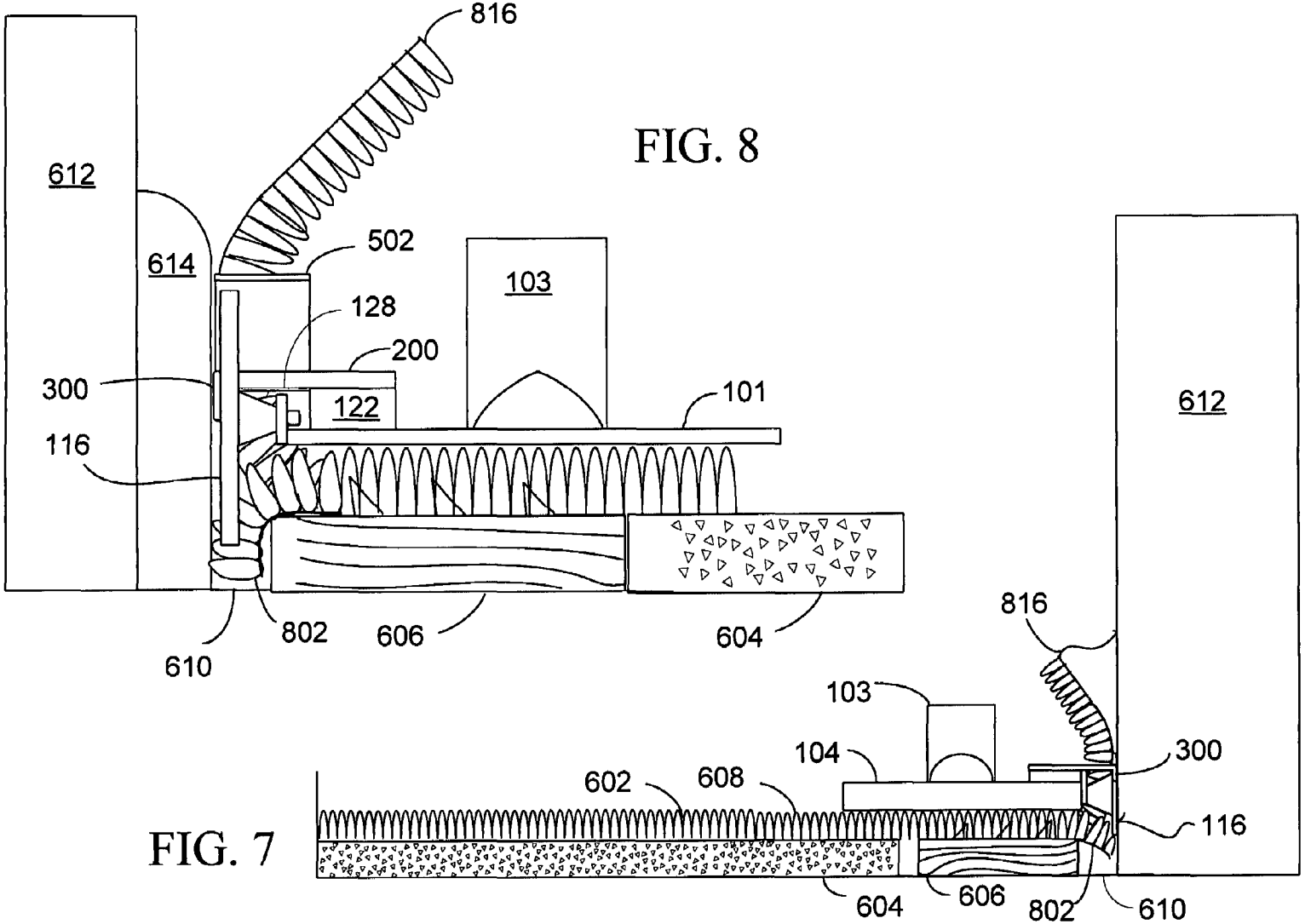
FIG. 7 is a side elevation view of an exemplary embodiment of the carpet trimmer and tucker with a carpet deflector in operation along a wall.
FIG. 8 is a side elevation view of an exemplary embodiment of the carpet trimmer and tucker with a carpet deflector in operation along a baseboard.

FIG. 7 shows an exemplary embodiment of the carpet trimmer and tucker 100 in end elevation view in operation on the carpet 602 of FIG. 6 but without a baseboard. 614. Guide 300 is flush against wall 612 as are wheels 115–116. Base plate 101, (FIG. 5) is used to press the carpet 708 down onto tacking strip 706. Inclined lip 104 eases the passage of the carpet trimmer and tucker over the carpet. Excess carpet 816 is trimmed by trimmer 250 to leave a tuckable carpet edge 802. Tuckable carpet edge 802 is tucked into gap 610, or tucking trough 610, where it is held by the natural resiliency of the material exerting forces against the wall 612 and tacking strip 606. The tacking strip 606 relieves the tucked carpet edge 802 of tension forces in carpet 702. Accordingly, the resilient forces exerted by the tucked carpet edge 802 is sufficient to retain the tucked carpet edge 802 in the tucking trough 610. The trimmed carpet 816 is conventionally discarded.

FIG. 8 shows a more detailed end elevation view of an exemplary embodiment of the carpet trimmer and tucker 100 in operation on the carpet 602 of FIG. 6. Inclined lip 104 is not shown in this view, so that the reader may appreciate the elevation of trimmer parts above the baseplate 101. In this view, guide 300 extends further outboard than the wheels 115–116, providing an offset of the wheel from the baseboard 614. Guide 300 is integral to cover plate 200 which is attached to trimmer support structure 122. Trimmer blade 128 is exposed within the carpet channel 202 (FIG. 3A) to engage excess carpet 816. Carpet deflector 502 prevents trimmed excess carpet 816 from becoming entangled in wheels 115–116. In an embodiment for short baseboards, guide 300 may be extended over the baseboard 624 to engage the wall 612, while wheels 115–116 remain in the tucking trough 610.

From FIG. 8, the reader may appreciate that for different thicknesses of carpet 602, padding 604, and tacking strips 606, different trimmer 250 heights may be needed. When the wheel heights are adjusted on the carpet tucker 100 to adapt to different carpet sizes, the size of trimmed edge 802 changes because the height of the trimmer blade 128 above the floor also changes with the wheel adjustment. However, the inherent change in trimmed edge 802 size resulting from a wheel height adjustment may not always be the correct amount of change. Accordingly, a trimmer support structure 122 may comprise a height adjustment. For example, a screw-operated scissor lift may be employed for a height adjustment. For further example, trimmer support structure 122 may comprise a plurality of plates which may be installed or removed to adjust height. Likewise, to adapt to different configurations of baseboards 614, an adjustable extension of the guide 300 is desirable. Screw-driven adjusters may be used for the purpose. Alternatively, a lockable slider may be used for the extension.

FIGS. 10A–10G show top plan views of a variety of exemplary configurations of blades 834*a*–834*g* that are within the spirit and scope of the invention. FIGS. 10A–10G show complimentary pins 303*a*–303*g* in respective through openings. Similarly, FIGS. 10A–10G show complimentary protrusions 865*a*–865*g* disposed in respective through openings that will be describe below. As can be appreciated, exemplary cross sectional shapes of the pins and protrusions are depicted together with their general complimentary mating relationships.

Figure 10A:
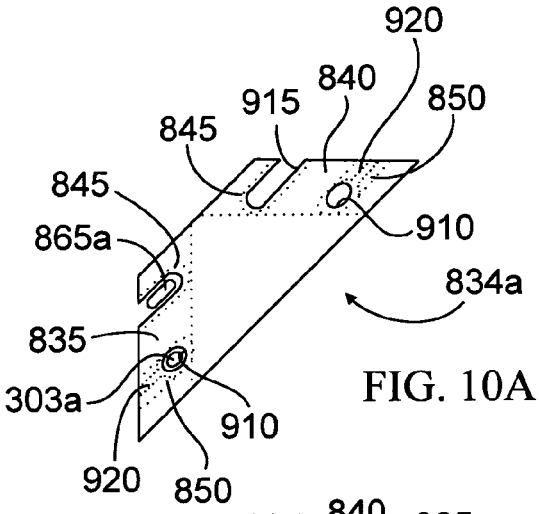
FIGS. 10A–10G are top plan views of exemplary alternative embodiments of blades that can be used in combination with the carpet trimmer and tucker.

FIG. 10A has a blade 834*a* with an oval closed through opening 910 similar to the previously described bore 127. However, the oval through opening 910 is shown in each of regions 835, 840. Additionally, the blade 834*a* has additional open through openings or notches 915 that open out into one side of the blade 834*a*. Through openings 910 could alternatively be made reentrant by reentrant cutouts 920. This could provide the advantage of accommodating a spring biased pin having small and large diameters in which the small diameter is brought into the through opening when in the retracted position. This can advantageously enable positioning a spring below the cover plate surface as will be described with regard to alternative embodiments for the pin or bolt 303*a* below. The notches 915 in the blade 834*a* are oblong shaped openings that have the advantage of inhibiting rotational movement when mated with complimentary structure in the recess 129. The reentrant and closed through openings 910, 920 have the advantage of inhibiting translational movement of the blade 834*a* as well.

Figure 10E:
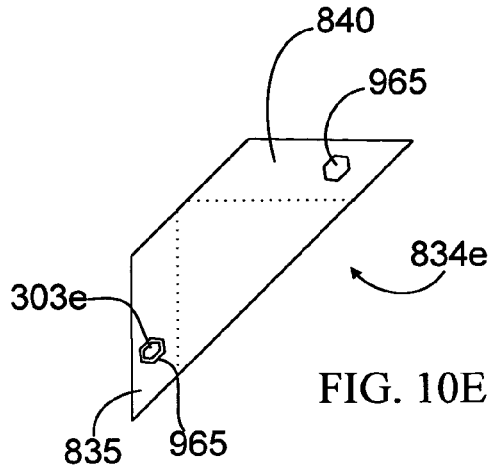
Figure 10B:
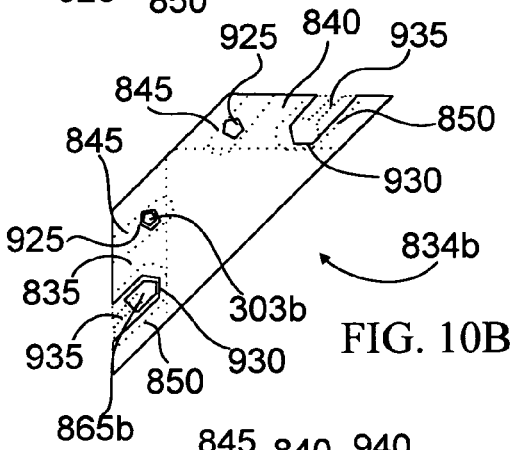

FIG. 10B shows a similar blade 834*b* but having the closed and open through openings 925, 930 reversed in position relative to long and short sides of the trapezoidal blade 834*b*. The closed through openings 925 have a pentagonal shape that advantageously inhibits rotational movement when engaged by a mating complimentary pin 303*b* of pentagonal cross section. The open through openings or notches 930 can be made reentrant similar to those of FIG. 10A by alternative cuts 935. Similar advantages to those described relative to FIG. 10A are achieved by the respective closed, open, and reentrant through opening configurations of the embodiments of FIG. 10B.

Figure 10F:
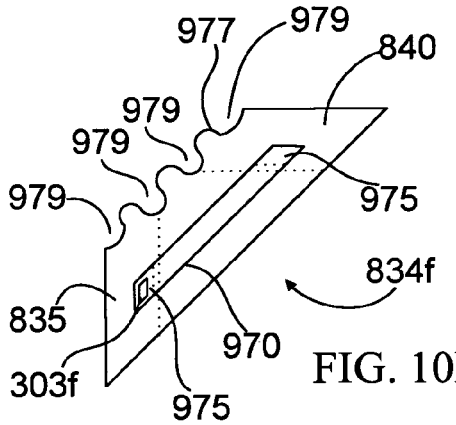
Figure 10C:
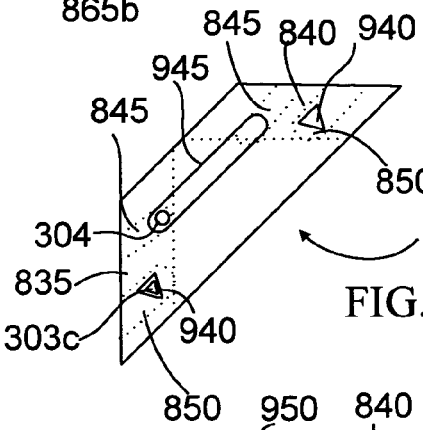

FIG. 10C has a modified blade 834*c* with closed triangular through openings 940 in respective securing regions 835, 840. A pin 303*c* having a triangular cross section can engage the through opening 940 in a complimentary relationship. A single oblong through opening 945 extends into each of securing regions 835, 840. A pin 304 of oblong or round cross section could engage opposite ends of the oblong through opening 945.

Figure 10G:
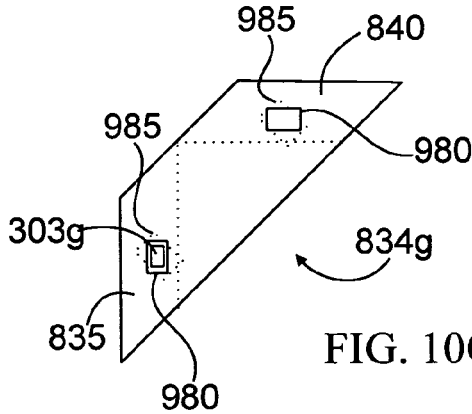
Figure 10D:
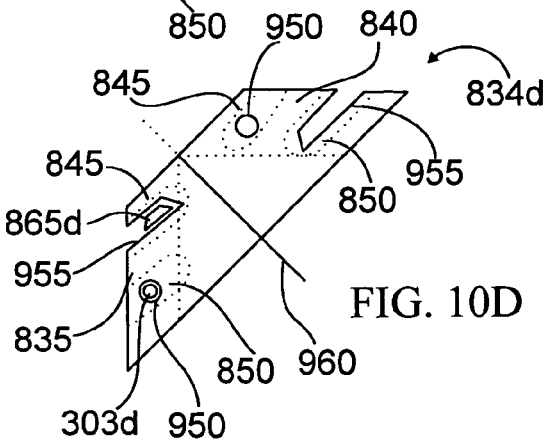

FIG. 10D shows a modified blade 834*d* having closed through openings 950 and open through openings 955. The closed through opening 950 is closest to the short side of the blade 834*d* in one of the securing regions 835, 840 and closest to the long side in the other. While this configuration does not provide a mirror image about short axis 960 as do the blades 834*a*–834*c* described above, the blade 834*d* could be removed from a first recess 129 rotated ninety degrees and placed in a second recess 129 at the other end of a bi-directional tool 100 when the structure in the recesses has been configured to accommodate the structure of modified blade 834*d*.

It should be noted that each of blades 834*a*–834*d* have through openings in respective areas 845, 850. Two spaced through openings of this configuration additionally inhibit rotational movement of the blades 834*a*–834*d* when both of the through openings are engaged by complimentary structure in the recess and on the pin 303. In this regard, the through openings could be round or otherwise not individually inhibit rotational movement, yet still collectively inhibit rotational movement. As can be appreciated, providing a plurality of through openings of oblong or polygonal shape in spaced relation in each of the securing regions and with any of the variety of through opening shapes shown in FIGS. 10A–10D provides the potential of several levels of redundancy for inhibiting rotational and translational movement of the blades 834*a*–834*d* in the recess 129.

FIG. 10E shows a blade 834*e* having another polygonal shaped through openings in the form of hexagonal through openings 965. FIG. 10F has a single oblong through opening 970 that extends into both of regions 835, 840 of a modified blade 834*f*. Alternatively, discrete through openings in the form of diamond shaped through openings 975 could be provided. (Note the different uses of the dashed lines in FIGS. 10A–10G, in which some are used to demarcate the regions 835, 840 and areas 845, 850. Other dashed lines are used to show alternative structure such as the discrete diamond shaped through openings 975 in FIG. 10E.) While the through openings 975 are shown as diamond shaped, any tetrahedral shape could be substituted including rectangular or trapezoidal. An arcuate wave shaped through opening 977 can be provided along a short edge of blade 834*f*. As can be appreciated, a pin 303 could engage in any of the notches 979 formed between individual waves and function similarly to engagement with through openings as described herein. FIG. 10G has a blade 834*g* with closed through openings that are formed by rectangular or square through openings 980. The through openings 980 could be oriented at any angle as indicated at 985. The additional structure of FIGS. 10E–10G can be incorporated into any of the embodiments of the blades 128 and 834*a*–834*d*. Similarly, any of the structure of the embodiments of blades 128 and 834*a*–834*d* could be incorporated into any of blades 834*e*–834*g*.

While the pins 303*a*–303*g*, protrusions 865*a*–865*g*, and the respective through openings into which they fit have been described as "complimentary", it is to be understood that complimentary can be taken in its broadest sense to mean that the pin and the through opening generally fit each other. For example, an oval pin may be used in conjunction with an oblong notch, or a triangle may function adequately in a diamond shaped through opening. Furthermore, since there is a redundancy with a protrusion in the through opening forming a notch and a pin in the closed through opening, securing can be accomplished with pins and protrusions that would not normally be considered to be compliments. However, for the present inventions, the term complimentary can simply mean that a particular through opening has at least a first dimension and the protrusion or pin engaging the through opening has at least a second dimension slightly smaller than the first dimension so as to be received in the through opening in a generally fitted relation. For example, a round pin having a diameter slightly smaller than a side dimension of a square through opening can function together with an associated protrusion in its respective notch to prevent rotational and/or translational movement of the blade. Hence, the present invention may be practiced with pins and protrusions having shapes that are not complimentary in a strict sense, but which have complimentary dimensions to dimensions of the through openings in which they engage.

Figure 11A:
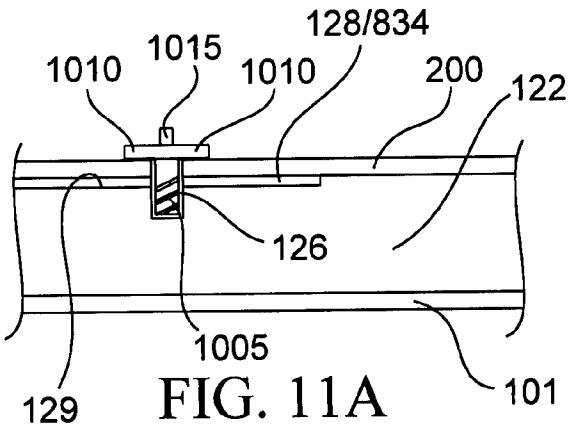
FIGS. 11A–11B are sectional side views showing alternative pins for securing the blades in the tools.

FIGS. 11A–11D show alternative embodiments for the pin 303. While several exemplary alternatives for the cross sections of the pins 303 have been shown in FIGS. 10A–10G, FIGS. 11A–11C show alternatives for retaining pins in securing positions. FIG. 11A is a sectional view of one of the alternative embodiments as taken along lines 11—11 of FIG. 1B showing a threaded screw pin 1000 that has large pitch threads 1005 for causing quick release when turned in a counterclockwise direction. The screw pin 1000 has wings 1010 to help a user turn the pin 1000. In the secured configuration shown in FIG. 11A, the screw pin 1000 passes through the retaining bore 227, the closed through opening or bore 127 in the blade 128, 834, and engages in the bore 126 in the base structure 122. Female threads can be provided in the bore 127 of the base structure 122 to mate with the threads 1005 of the screw pin. Thus, the blade 128, 834 is held against translational movement when the screw pin is in the securing configuration. The screw pin includes a peg 1015 that is useful when the screw pin 1000 is removed from the securing configuration as will be described below with regard to a similar peg in the embodiments of FIGS. 11B–11D.

Figure 11B:
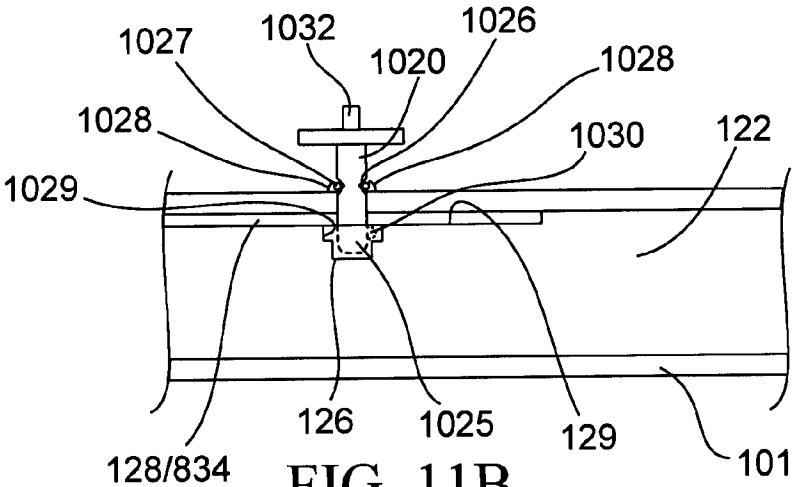
Figure 11C:
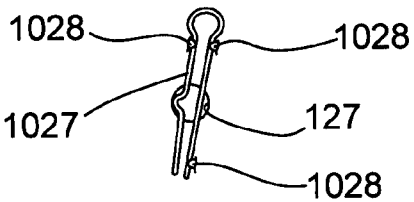
FIG. 11C is a diagrammatic top plan view of a feature of FIG. 11B.

FIG. 11B is another alternative taken as along lines 11—11 in FIG. 1B and shows a spring clip pin 1020 or ball detente pin 1025. The spring clip pin 1020 has a notch 1026 extending radially into an outer surface of the pin 1020. A spring clip 1027 engages the notch 1026 to hold the pin 1020 to the extent that the spring clip is held to the cover plate 200. Furthermore, the spring clip 1027 is resilient and permits the pin 1020 to be forced between the arms of the spring clip 1027 into a securing configuration with the spring clip 1027 in the notch 1026. To this end, the spring clip 1027 is mounted on the cover plate 200 by brackets such as nibs 1028 as shown in FIGS. 11B and 11C. The spring clip 1027 can be held by a variety of alternative or additional structures including clamps, welds, and slots. Alternative positions for the spring clip 1027 can include a sandwiched position between the base structure 122 and the blade 128, 834 in a laterally extending recess 1029 in the base structure 122 as shown in FIG. 11B. In this case, the pin 1020 would need to extend into the bore 126 as generally shown in the alternative of dashed lines at 1025. In this case, the dashed portion of the pin would comprise the radially extending notch 1026.

FIG. 11B further shows a specific alternative in the form of the ball detente pin 1025. This alternative embodiment does not require a radially extending notch 1026, but rather has a spring biased ball 1030 that is biased outwardly to engage in the laterally extending recess 1029 in the base structure 122. The ball detente pin 1025 operates under a pulling action in an axial direction with a force greater than or equal to a particular minimum. This force on the pin that forces at least one ball 1030 radially inwardly to overcome the spring biasing of a spring inside the pin 1025. Thus, the pin 1025 is permitted to slip out of the recess 1029 past the blade 128, 834 and past the cover plate 200. Otherwise, the pin remains in a securing configuration shown in FIG. 11B.

It is to be understood that the embodiments shown and described with respect to Figures of 11A–11C are exemplary only, and other pins or similar devices can alternatively or additionally be used. For example, there are bush-button pins that are easily manipulated and moved into a release configuration by pressing a button on a top side while pulling the pin by engaging one's fingers on an underside of a gripping portion of the pin. Further alternatively, the pin may be a non-removable pin that has two diameters as described above with regard to re-entrant notches for receiving and releasing a small diameter portion of the pin in a retracted orientation. Still further, it is to be understood that the pin is not limited to narrow elongated members, but can include a mechanism of any shape or size that blocks movement of a blade out of the recess. For example, the pin could be a small flat member or a member with at least one tooth for engaging through opening(s).

Figure 11D:
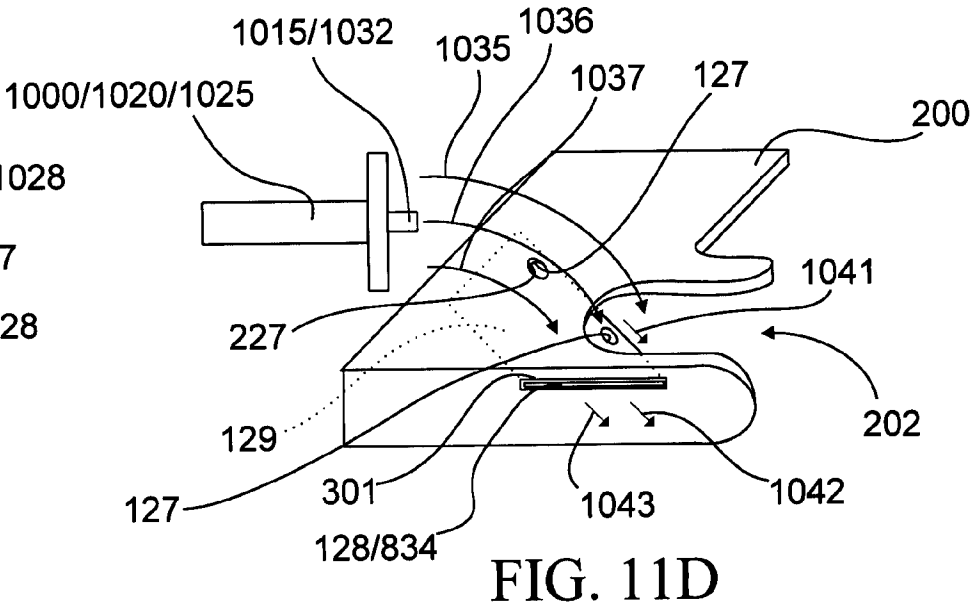
FIG. 11D is a perspective diagrammatic view showing structure and a method in accordance with the embodiments of FIGS. 11A-11C.

The removable pins can include a peg 1032 or a peg 1015 as shown in FIGS. 11A, 11B, and 11D. The pegs 1015, 1032 can be used to engage the through openings in the blades 128, 834, such as 127, that are positioned in carpet channel 202 as shown in FIG. 11D. To this end, the pin 1000, 1020, 1025 can be removed from a securing configuration in the bore 227 and rotated into position as shown by arrows 1035, 1036, 1037 in FIG. 11D. The peg 1015, 1020 is inserted into the through opening 127 in the blade 128, 834 that is positioned in the carpet channel 202. Then the blade 128, 834 can be translationally moved out of the recess 129 in the base structure 122 and through the slot 301 as shown by arrows 1041, 1042, 1043. Sliding the blade 128, 834 in this manner has the advantage of moving the blades 128, 834 into an easily removable configuration without the need to touch the blade near its sharp portions. Once the blade is moved to a position indicated by the arrows 1041, 1042, 1043, a non-sharp short back edge of the blade 128, 834 is exposed for safe grasping by a user's hand without the need to touch the sharp portion of the blade 128, 834 that is disposed in the channel 202.

It is to be understood that the embodiments shown and described as related to FIGS. 11A-11D can be used with any of the embodiments of the blades shown in FIGS. 10A–10G. Thus, the pins of FIGS. 11A–11D can have any cross sectional shape within the spirit and scope of the invention as set forth above.

Figure 12:
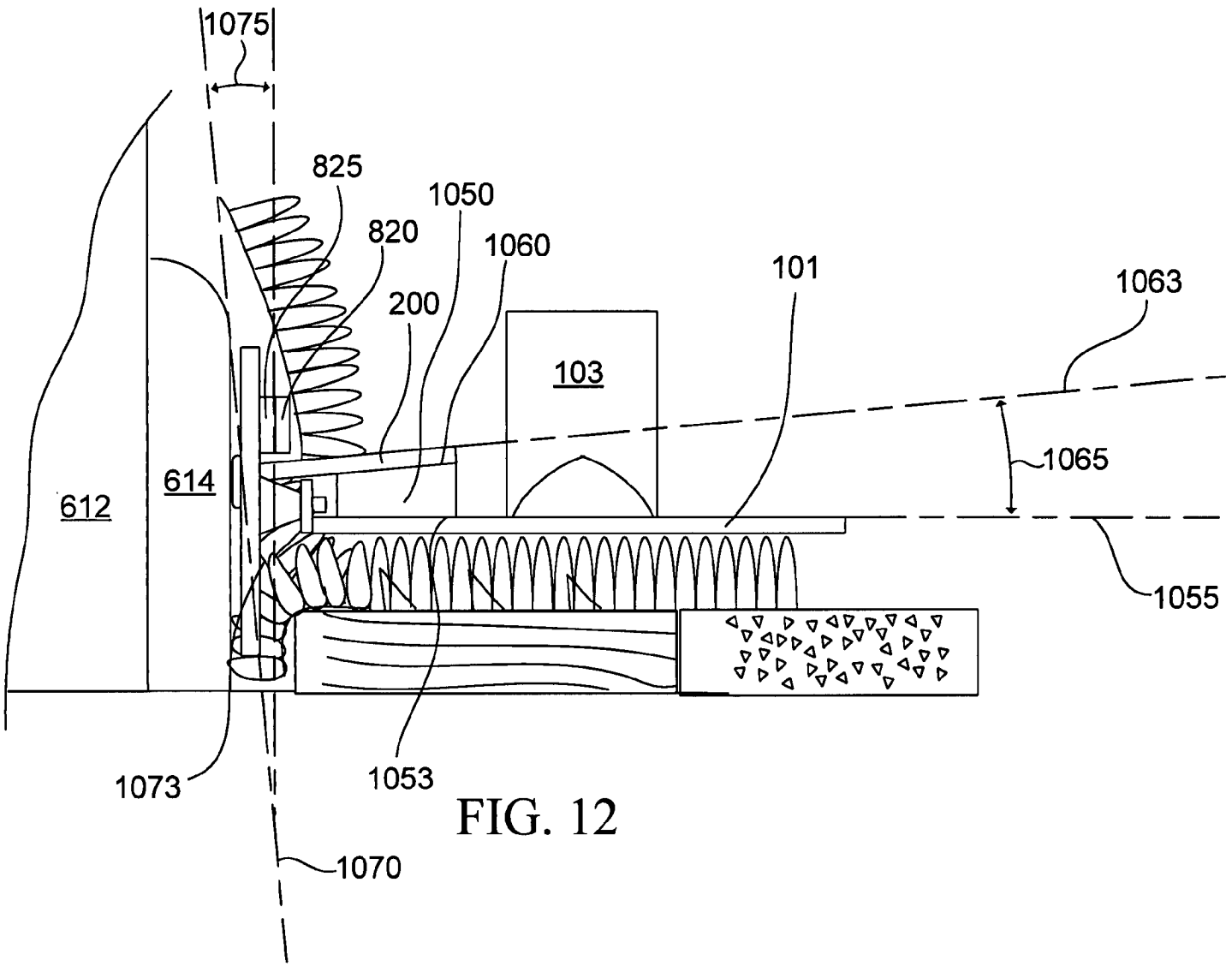
FIG. 12 is a sectional view similar to FIG. 8, yet showing the embodiment of FIGS. 1B, 5B, 9B, and additional features.

FIG. 12 is a cross sectional view similar to FIG. 8 and taken along lines 12—12 in FIG. 2A, but showing the embodiment of FIGS. 1B, 5B, and 9B in a modified form. In particular, it should be noted that the base structure 1050 in this embodiment is slightly wedge shaped. An underside 1053 of the base structure 1050 is supported on and lies generally in a plane 1055 of an upper surface of the baseplate 101. The topside 1060 of the support structure 1050 supports the cover plate 200 thereon generally in a plane 1063 angled downwardly and toward the tucking wheel 116. The angle 1065 at which the plane 1063 is disposed relative to the plane 1055 of the base plate 101 is in the range from approximately zero to approximately forty-five degrees. The angle 1065 can be in the narrower range from approximately zero to approximately ten degrees. In one particular case, the angle 1065 can be in the range from approximately four to approximately seven degrees.

The angle 1065 can advantageously be selected to place the plane 1063 of the cover plate 200 and the blade 128, 834 generally perpendicular to a plane 1070 that is tangent to the carpet backing 1073 at a location where the carpet is being cut. This is desirable because carpet disposed at increasingly larger or decreasingly smaller angles than ninety degrees relative to the blade 128, 834 require slicing through increasingly more material. Therefore, providing the angle of the cover plate 200 and blade 128, 834 at an angle perpendicular to the carpet backing has the advantage of reducing the material through which the blade 128, 834 must cut.

With regard to FIG. 12, it should be noted that carpet layers of the past often angled the base plate 101 as they made cuts in order to enable better function of the blade 128, 834 and tool overall. This is a less than ideal technique that depends heavily upon the carpet layer's skill and strength. As can be appreciated, maintaining the base plate 101 at the ideal angle can eventually cause fatigue of certain muscles. In accordance with the present invention, the angled blade 128, 834 and structure that supports the blade 128, 834 of FIG. 12 obviate the need to implement this less than ideal practice of manually holding the base plate 101 at a specific angle other than flat against the carpet. Now the tool can be held flat on the carpet during trimming and tucking. This alleviates muscle fatigue and enables greater consistency in cutting and speed. It should be noted that with other tool configurations within the spirit and scope of the invention, the blades 128, 834 may need to be disposed at larger angles 1065 in order to provide the perpendicular relation between the blade 128, 834 and the carpet at the point being cut.

In the embodiment shown in FIG. 12, the carpet bends from being flat on the floor upward in a direction toward the wall 612 and the baseboard 614. As can be appreciated, the carpet becomes almost parallel with the baseboard 614 and wall 612 at a position where the blade engages the carpet backing 1073 in front of the tool before trimming and tucking. The plane 1070 tangent to the carpet backing 1073 at this engagement position defines an angle 1075 extending upwardly and toward the wall 612 at less than approximately ten degrees to the vertical. Thus, this angle 1075 calls for the base structure 1050 to form a wedge shape, and to angle downwardly and toward the wall 612 at a similar angle relative to the horizontal in order to provide a generally perpendicular relation between the blade 128, 834 and the carpet at the cutting position. With this structural configuration, the baseplate 101 can be kept parallel to the floor during cutting and the tool will still perform ideally. Tucking trough depths and carpet qualities and thicknesses will vary. Therefore, the angle 1075 of the backing 1073 will vary. However, the variations in the angle 1075 will not cause significant deviations from the angle 1065. That is, even though the angle 1075 varies somewhat as the carpet qualities and the tucking trough depth vary, the angle 1065 of the cover plate 200 and blade 128, 834 will still function generally ideally. Alternatively, the base structure 122, 1050, cover plate 200, and/or the blade 128, 834 can be made adjustable to accommodate the variations from one combination of carpet qualities and materials to another. By way of example and not by way of limitation, such adjustments could be provided by mechanisms incorporating hinges, clamps, screws, and sets of base structures having wedge sections of a plurality of angles.

It should be noted that while the flange 102 and base plate 101 remain perpendicular to each other, the blade 128, 834 and the cover plate 200 are disposed at an angle that depends on the wedge shape of the base structure 1060. Similarly, the trailings guide 820 normally remains perpendicular to the base plate 101. Thus, the flange 102 and trailings guide 820 remain in an upright orientation relative to the base plate 101 even when the blade 128, 834 is angled relative to the base plate 101. However, the cover plate 200 has the integral guide 300 that normally extends perpendicularly from a generally horizontal portion of the cover plate 200 as can be appreciated from FIGS. 2A–3C. Thus, as the angle 1060 of the blade 128, 834 and cover plate 200 are increased, the angle of the guide 300 relative to the vertical is also increased in a position of use. When the guide 300 is in a range from zero to ten degrees relative to the vertical it is also at approximately the same angle relative to the wall 612 and baseboard 614. The guide 300 can be abutted against the wall 612 or baseboard 614 at an angle in this range without gauging or marring wall 612 or baseboard 614. However, if the angle is greater than approximately ten degrees, the guide 300 will present a sharp edge that will likely mar or deface the wall 612 or baseboard 614. Therefore, in configurations in which the blade 128, 834 and cover plate 834 will be disposed at angles greater than ten degrees to the horizontal, the guide should be oriented so that it is substantially vertical during use. That is, even if the cover plate 200 is angled relative to the base plate 101, the guide should be oriented generally perpendicular to the base plate 101. This can be accomplished by a permanent bend in the cover plate or by providing an angularly adjustable guide such as by a hinge, clamp, and/or threaded adjustment mechanism. It is to be understood that providing ideal angles for the blades 128, 834, cover plates 200, and support structure 122, 1050, and at the same time providing the ideal orientation for guides 300 in accordance with the above teachings is considered to be applicable to any of the embodiments of the invention.

The foregoing description has set forth selected embodiments of a carpet trimmer and tucker. While the invention has been particularly shown and described with reference to selected embodiments thereof, it will be readily understood by one of ordinary skill in the art that, as limited only by the appended claims, various changes in form and details may be made therein without departing from the spirit and scope of the invention. For example, while the description is to a hand tool, it is possible to replace the handle with an adapter for a work boot or shoe, so that the tool may be used by a person who is in an upright position, rather than kneeling as the hand tool requires. Likewise, an extended handle, such as a shovel handle, may be used to allow for operation of the carpet trimmer and tucker while standing.

What is claimed is:

1. A carpet tucker and trimmer, comprising:

a base;

a handle connected to the base, wherein the combined handle and base plate comprise a base unit for the device;

at least one wheel connected to the base unit;

at least one blade supported on the base unit for trimming carpet; and a trailings guide supported on the base unit and extending generally between the at least one wheel and the at least one blade.

2. The carpet tucker and trimmer of claim 1, wherein:

the base generally defines a plane;

the carpet tucker further comprises a flange extending transversely to the plane;

the flange supports the at least one wheel; and the trailings guide is integral with the flange.

3. The carpet tucker and trimmer of claim 2, wherein the trailings guide comprises:

a central portion generally parallel to the handle; and at least a first end connected to and extending away from the central portion.

4. The carpet tucker and trimmer of claim 3, wherein:

the at least one blade has an exposed cutting edge; and the first end extends away from the central portion to a position generally between the at least one wheel and the cutting edge.

5. The carpet tucker and trimmer of claim 3, wherein:

the trailings guide further comprises a second end extending away form the central portion in a direction generally opposite to the first end;

the at least one blade is a first blade and the base has a second blade supported thereon, the second blade having an exposed cutting edge; and the first and second ends extend away from the central portion to positions generally between the at least one wheel and respective cutting edges of the first and second blades.

6. The carpet tucker and trimmer of claim 3, wherein:

the flange is positioned between the at least one wheel and the handle; and the first end extends away from the handle toward a plane of the at least one wheel to guide carpet trailings away from the at least one wheel as the trailings move generally toward the central portion.

7. The carpet tucker and trimmer of claim 3, wherein:

the at least one blade is at least two blades including a first blade and a second blade;

the trailings guide further comprises a second end extending away from the central portion in a direction generally opposite to the first end; and the first and second ends of the trailings guide extend away from the handle toward the plane of the at least one wheel and between the at least one wheel and the respective first and second blades to guide carpet trailings away from the at least one wheel as the trailings move generally toward the central portion from both the first and second ends so that the carpet tucker and trimmer provides a bi-directional tool capable of trimming and tucking in two opposite directions.

8. The carpet tucker and trimmer of claim 2, wherein:

the trailings guide further comprises a second end extending away form the central portion in a direction generally opposite to the first end; and the first and second ends extend perpendicularly to the base.

9. The carpet tucker and trimmer of claim 1, further comprising:

a recess in the handle; and a flip top cover on the handle covering the recess for enclosing and storing the at least one blade in the recess.

10. The carpet tucker and trimmer of claim 1, wherein:

the base generally defines a plane; and the blade is disposed at an angle in a range from approximately zero degrees to approximately forty-five degrees relative to the plane of the base and extending toward the base and away from the handle.

11. The carpet tucker and trimmer of claim 1, wherein:

the base generally defines a plane; and the blade is disposed at an angle in a range from approximately zero degrees to approximately ten degrees relative to the plane of the base and extending toward the base and away from the handle.

12. The carpet tucker and trimmer of claim 1, wherein:

the base generally defines a plane; and the blade is disposed at an angle in a range from approximately four degrees to approximately seven degrees relative to the plane of the base and extending toward the base and away from the handle.

13. A carpet trimmer and tucker tool and a blade, the tool comprising:

a base;

a handle connected to the base, wherein the combined handle and base plate comprise a base unit for the device;

at least one wheel connected to the base unit;

a recess in the base, the recess receiving the blade;

structure in the recess engaging structure on the blade and holding the blade against rotation;

a pin supported on the tool and traversing the recess in a securing position;

wherein:

the blade comprises at least one through opening that is re-entrant or closed;

the pin engages the through opening in the blade and inhibits translational movement of the blade out of the recess when the pin is in the securing position; and the pin is movable into a non-securing position that permits translational movement of the blade out of the recess.

14. The tool and blade of claim 13, wherein the pin has a polygonal cross section.

15. The tool and blade of claim 13, wherein the pin has an oblong cross section.

16. The tool and blade of claim 13, wherein:

the structure in the recess comprises a protrusion;

the structure on the blade comprises an oblong notch;

a shape of the protrusion is a compliment of a shape of the oblong notch; and the protrusion inhibits rotation of the blade relative to the tool.

17. The tool and blade of claim 13, wherein:

the structure in the recess comprises a protrusion having a first dimension;

the structure on the blade comprises an oblong notch having a width of a second dimension; and the first dimension is complimentary to the second dimension so that the protrusion is received into and removed from the notch in a relative translational motion.

18. The tool and blade of claim 13, wherein the tool further comprises a retaining structure for holding the pin on the tool in the securing position.

19. The tool and blade of claim 18, wherein the retaining structure further comprises:

threads on the pin; and female threads for receiving the threads of the pin to secure the pin to the rest of the tool in the securing position.

20. The tool and blade of claim 18, wherein the retaining structure further comprises:

a notch on the pin; and a spring pin secured to the tool and engaging the notch to hold the pin on the rest of the tool in the securing position.

21. The tool and blade of claim 18, wherein the retaining structure further comprises:

a spring biased detente on the pin; and a recess in the tool, the recess engaged by the spring biased detente to hold the pin on the rest of the tool in the securing position.

22. The tool and the blade of claim 18, wherein:

the at least one through opening is a first through opening;

the blade further comprises a second through opening; and the pin further has a peg for engaging the second through opening in the blade and for causing the translational movement in order to slidingly remove the blade from the recess.

* * * * *